US011484888B2

(12) United States Patent
Lee

(10) Patent No.: US 11,484,888 B2
(45) Date of Patent: Nov. 1, 2022

(54) CONDUCTIVE FILTER UNIT, CONDUCTIVE FILTER MODULE INCLUDING CONDUCTIVE FILTER UNIT, AND FINE DUST REMOVING SYSTEM HAVING CONDUCTIVE FILTER MODULE

(71) Applicant: ALINK CO., LTD, Changwon-Si (KR)

(72) Inventor: Hye Moon Lee, Changwon-Si (KR)

(73) Assignee: ALINK CO., LTD, Changwon-Si (KR)

( * ) Notice: Subject to any disclaimer, the term of this patent is extended or adjusted under 35 U.S.C. 154(b) by 247 days.

(21) Appl. No.: 16/642,138

(22) PCT Filed: Jul. 24, 2018

(86) PCT No.: PCT/KR2018/008361
§ 371 (c)(1),
(2) Date: Feb. 26, 2020

(87) PCT Pub. No.: WO2019/045278
PCT Pub. Date: Mar. 7, 2019

(65) Prior Publication Data

US 2020/0353479 A1 Nov. 12, 2020

(30) Foreign Application Priority Data

Sep. 1, 2017 (KR) ..... 10-2017-0112024
Dec. 14, 2017 (KR) ..... 10-2017-0172584

(51) Int. Cl.
*B03C 3/06* (2006.01)
*B03C 3/36* (2006.01)
(Continued)

(52) U.S. Cl.
CPC ..... *B03C 3/06* (2013.01); *B03C 3/025* (2013.01); *B03C 3/155* (2013.01); *B03C 3/368* (2013.01);
(Continued)

(58) Field of Classification Search
CPC combination set(s) only.
See application file for complete search history.

(56) References Cited

U.S. PATENT DOCUMENTS 3,105,750 A * 10/1963 Kayko ..... B03C 3/66 96/17
6,497,753 B1 * 12/2002 Gutmann ..... B03C 3/025 96/381
(Continued)

FOREIGN PATENT DOCUMENTS

KR 10-2012-0027543 3/2012
KR 10-2012-0033594 4/2012
(Continued)

OTHER PUBLICATIONS

International Search Report for International Application No. PCT/KR2018/008361 dated Apr. 5, 2019.

*Primary Examiner* — Christopher P Jones
*Assistant Examiner* — Sonji Turner
(74) *Attorney, Agent, or Firm* — Bond Schoeneck & King, PLLC; Joseph M. Noto

(57) ABSTRACT

The present disclosure relates to a fine dust removal system including a conductive filter module, and more particularly, to a fine dust removal system having a conductive filter module which includes a cylindrical conductive filter to thereby implement high fine dust removal efficiency with low pressure loss and which can be easily, generally applied to and used in an air cleaner to be installed in windows or in an independent indoor air cleaner.

14 Claims, 25 Drawing Sheets

(51) Int. Cl.

| | |
|---|---|
| ***B03C 3/41*** | (2006.01) |
| ***B03C 3/49*** | (2006.01) |
| ***B03C 3/45*** | (2006.01) |
| ***B03C 3/82*** | (2006.01) |
| ***B03C 3/02*** | (2006.01) |
| ***B03C 3/155*** | (2006.01) |

(52) U.S. Cl.
CPC ..... *B03C 3/41* (2013.01); *B03C 3/455* (2013.01); *B03C 3/49* (2013.01); *B03C 3/82* (2013.01)

(56) References Cited

U.S. PATENT DOCUMENTS

| | | | | |
|---|---|---|---|---|
| 8,361,402 | B2 * | 1/2013 | Tsui | B01D 53/323<br>422/186.18 |
| 9,114,404 | B2 * | 8/2015 | Alam | B03C 3/60 |

FOREIGN PATENT DOCUMENTS

| | | | | |
|---|---|---|---|---|
| KR | 10-2016-0115211 | | 10/2016 | |
| KR | 10-2016-0143049 | | 12/2016 | |
| KR | 10-2017-0095746 | | 8/2017 | |
| WO | WO-2009106192 | A1 * | 9/2009 | B03C 3/41 |

* cited by examiner

CONDUCTIVE FILTER UNIT, CONDUCTIVE FILTER MODULE INCLUDING CONDUCTIVE FILTER UNIT, AND FINE DUST REMOVING SYSTEM HAVING CONDUCTIVE FILTER MODULE

REFERENCE TO RELATED APPLICATION

This application is a U.S. National Phase filing of International Application No. PCT/KR2018/008361, filed Jul. 24, 2018, which relates and claims priority to Korean Application Nos. 10-2017-0112024, filed Sep. 1, 2017, and 10-2017-0172584, filed Dec. 14, 2017, the entirety of each of which are hereby incorporated by reference in their entirety.

BACKGROUND OF THE INVENTION

Field of the Invention

The present disclosure relates to a fine dust removal system including a conductive filter module, and more particularly, to a fine dust removal system having a conductive filter module which includes a cylindrical conductive filter to thereby implement high fine dust removal efficiency with low pressure loss and which can be easily, generally applied to and used in an air cleaner to be installed in windows or in an indoor independent air cleaner.

Related Art

Fine dust, so small in size, has characteristics of penetrating deep into the alveoli, without being caught in mouth, noise, bronchial tubes, and the like and has optical characteristics such as refraction and scattering of light, causing many problems in securing a field of vision. In addition, fine dust contains many organic and inorganic harmful substances, so fine dust penetrating to the lungs remains in the lungs and delivers various organic and inorganic harmful substances contained therein to the human body to cause very serious respiratory diseases such as pneumonia, lung cancer and bronchitis.

Fine dust, as well as moving pollution sources such as automobiles or the like in our country, fixed pollution sources that are used by household heating, industrial energy consumption, and the like, yellow dust that originates in Gobi Desert in China, and the recent large-scale industrialization of China has put all over East Asia into a serious situation, causing people to suffer hardships even in indoor areas, as well as outdoor areas.

Most air filters for removing fine dust in the rooms use a method using filters. Among the filters used to remove fine dust, HEPA filters exhibit a high fine dust filtration rate capable of collecting 99.97% of fine particles having a diameter of 0.3 μm.

However, HEPA filters are very effective at removing fine dust, but nano-scale micropolymer or glass fibers are very tightly intertwined, resulting in very low air permeability. That is, pressure loss is very large. Therefore, when the HEPA filter is used for an air cleaning system that removes fine dust, a large-capacity blower is required, and thus, power consumption is large and noise and vibrations are severe, thereby additionally requiring facilities for soundproofing and dustproofing. In addition, the HEPA filter, once used, cannot be reused and need to be replaced every 6 to 12 months.

In recent years, various functional filter materials have been introduced to compensate for the disadvantages of the HEPA filter. Typical filter materials include an electret filter that effectively collects fine dust in the air through electrostatic force because the filter material itself is positively or negatively charged. However, the electric charge characteristics of the electret filter disappear as dust is collected and accumulated, and the electric charge characteristics easily disappear if the electret filter is not used for collecting particulate contaminants but simply kept in storage for a long period of time. Even when a surface of the electret filter is exposed to water or alcohol, the charge characteristics are very easily removed, and thus fine dust removal ability is significantly reduced.

In order to solve the problem that the charge characteristics of the electret filter are easily extinguished or lowered over time naturally or by external damage, a filter for air purification in which conductive filters are provided above and below a filter having dielectric properties in an overlapping manner and positive and negative high voltages or negative and positive high voltages are applied thereto to electrically polarize a dielectric filtering agent so as to be electrostatically activated has been developed (Korean Laid-Open Publication No. 10-2011-0128465). However, the corresponding filter still involves process inconvenience that the filters are to be made to be a total of three layers and high pressure loss due to the layers of filters.

Also, a method of effectively removing fine dust by applying a conductive filter obtained by coating a general non-woven filter whose pressure loss is ⅕ to 1/20 that of a general HEPA filter with a metal to an electric precipitation type system has been introduced (ACS Appl. Mater. Interfaces 2017, 9, 16495-16504). In order to solve the high pressure loss problem of the HEPA filter, a filter material having low pressure loss is coated with a metal to have high electric conductivity to maximize an electric field with charged fine particles, by which fine dust may be removed to a level equal to that of the HEPA filter, while pressure loss is 1/10 that of the HEPA filter.

However, when a filter bending method, which is generally applied to remove a large amount of air in a certain volume of space, is applied to a conductive filter coated with a metal, an electric field is not uniformly formed and electrical attraction does not properly take place between electrically charged fine dust and the conductive filter so that fine dust is rarely removed. That is, in order to purify a large amount of air containing fine dust using a conductive filter material capable of maintaining a low pressure loss, a new filter module, rather than the existing filter bending method, should be provided.

Meanwhile, since ions are less generated between the conductive filter and an electrode rod inside the cylindrical module, ions generated in an ionizer at a front stage must be present even in the cylindrical module to achieve good fine dust removing efficiency. However, ions generated in the ionizer are so fast that a phenomenon that the ions are extinguished when coming into contact with an object present nearby is very high, and not many ions are introduced into the cylindrical module. That is, since only the particles charged by the ions generated in the ionizer may be removed in the conductive filter module, leading to a problem that fine particles not charged between the ionizer and the conductive filter module are not removed by the cylindrical conductive filter module.

Therefore, the inventors of the present application diligently studied to overcome the problems of the related art and recognized that a fine dust removal system including a cylindrical bent filter module and a conductive filter unit having an electrode rod including a conductive member with a carbon member had pressure loss of about 0.5 to 10 pa when a filtration velocity of air passing through an unbent filter module is generally 5 cm/sec, which exhibits pressure loss of about 1/20 to 1/5 as compared to a general HEPA filter, and even fine dust, which is not charged between an ionizer and the conductive filter module, could be charged by generating a strong electric field and a large amount of ions between the ionizer and a conductive filter, thereby efficiently purifying a large amount of air including fine dust, thereby completing the present disclosure.

SUMMARY OF THE INVENTION

The present disclosure provides a conductive filter module having a new structure capable of collecting and removing fine dust with high efficiency by forming a uniform electric field in a conductive filter.

The present disclosure also provides a fine dust removal system which has a cylindrical conductive filter module according to the present disclosure and which has excellent applicability.

In an aspect, a conductive filter unit includes a first electrode cap; a second electrode cap; a plurality of supports connecting the first electrode cap and the second electrode cap; a conductive filter surrounding an outer circumferential surface of the support, forming a space between the first electrode cap and the second electrode cap, and connecting the first electrode cap and the second electrode cap; and an electrode rod protruding from a central portion of the second electrode cap to an internal space formed by the conductive filter.

In addition, the electrode rod of the conductive filter unit may be disposed as a conductive member protruding to the internal space formed by the conductive filter from the second electrode cap or may include the conductive member protruding to the internal space formed by the conductive filter from the second electrode cap and a carbon member disposed on at least a portion of a surface of the conductive member.

In addition, the carbon member disposed on at least a portion of one surface of the conductive member of the conductive filter unit may include at least one of carbon fiber and powdery carbon fiber, the carbon fiber may have an average longitudinal length of 1 mm to 300 cm and the powdery carbon fiber may have an average particle diameter of 1 um to 1000 um.

In addition, the electrode rod of the conductive filter unit may protrude to extend to outside of the second electrode cap, and a protrusion degree may be any degree as long as the electrode rod can be connected to an external electrode.

In addition, the first electrode cap of the conductive filter unit may have a ring shape so that air may be introduced into the internal space of the conductive filter.

In addition, the conductive filter module may include: a filter fixing plate including at least one open air inlet; and a conductive filter unit mounted on the filter fixing plate.

In another aspect, a fine dust removal system including a conductive filter module may include: a housing; a conductive filter module disposed in a contaminated air inlet or a clean air outlet direction of the housing; and a blower disposed in the contaminated air inlet or clean air outlet direction of the housing to induce a flow of air.

In another aspect, a fine dust removal system including a conductive filter module may include: a housing; an ionizer disposed in a contaminated air inlet or a clean air outlet direction of the housing; a conductive filter module disposed to face the ionizer with a space therebetween; and a blower disposed in the contaminated air inlet or clean air outlet direction of the housing to induce a flow of air.

In addition, in the fine dust removal system including the conductive filter module, the housing in which the ionizer, the conductive filter module, and the blower are disposed may be disposed in an external housing provided with a contaminated air inlet and a clean air outlet.

Further, in the fine dust removal system including the conductive filter module, in a case where the fine dust removal system includes the ionizer, the housing in which the ionizer, the conductive filter module, and the blower are disposed may be disposed in the external housing provided with a contaminated air inlet and a clean air outlet correspondingly.

In addition, in the fine dust removal system including the conductive filter module, in a case where the fine dust removal system does not include the ionizer, the housing in which the conductive filter module and the blower are disposed may be disposed in an external housing provided with the contaminated air inlet and the clean air outlet correspondingly.

In addition, in the external housing of the fine dust removal system including the conductive filter module, the clean air outlet is fixed at an upper or lower opening of the window to face the interior.

In addition, the housing of the fine dust removal system including the conductive filter module may be fixed at a window frame of the window such that the clean air outlet faces the interior.

In addition, the external housing of the fine dust removal system including the conductive filter module may include a first contaminated air inlet and a second contaminated air inlet disposed at two different positions, and introduced contaminated air may be selected as outdoor air or indoor air by disposing the first contaminated air inlet and the second contaminated air inlet.

In addition, the fine dust removal system may further include: a damper disposed at each of the first contaminated air inlet and the second contaminated air inlet of the external housing of the fine dust removal system including the conductive filter module.

In addition, the housing of the fine dust removal system including the conductive filter module may be provided in the form of a stand on a fixed base or a rotary base rotated by a motor.

In addition, the housing of the fine dust removal system including the conductive filter module may be provided 50 cm to 150 cm above a bottom surface.

In addition, in the housing of the fine dust removal system including the conductive filter module, a circulation fan strengthen indoor air circulation may be separately installed at a portion 50 cm from the bottom surface.

In addition, upper and lower positions of the air cleaning structure and the air circulation structure may be interchanged as necessary.

In addition, the conductive filter module of the fine dust removal system including the conductive filter module may be mounted on the fine dust removal system equipped with a heat exchange system.

In another aspect, a fine dust removal system equipped with the heat exchange system may include: a housing; an outdoor air inlet providing a passage for outdoor air to be introduced into the housing; an indoor inlet discharging air introduced through the outdoor air inlet to the outside of the housing; an indoor air inlet providing a passage for indoor air to be introduced into the housing; an outdoor outlet discharging air introduced through the indoor air inlet to the outside of the housing; a heat exchange system controlling a temperature of air introduced from the outdoor air inlet; and a conductive filter module purifying outdoor air introduced into the heat exchange system from the outdoor air inlet.

In addition, the fine dust removal system equipped with the heat exchange system may further include a second conductive filter module purifying air introduced into the heat exchange system from the indoor air inlet.

In addition, the housing of the fine dust removal system equipped with the conductive filter module may be mounted at only one of the inlet through which outdoor air is introduced or the inlet through which indoor air is introduced, or at both thereof, as necessary.

DESCRIPTION OF EXEMPLARY EMBODIMENTS

Hereinafter, embodiments of the present disclosure will be described with reference to the accompanying drawings, but this is for easier understanding of the present disclosure and the scope of the present disclosure is not limited thereto.

Hereinafter, a conductive filter module 100 and a fine dust removal system 10 including the same according to an embodiment of the present disclosure will be described.

First, the conductive filter unit 110 of the present disclosure will be described.

Figure 1:
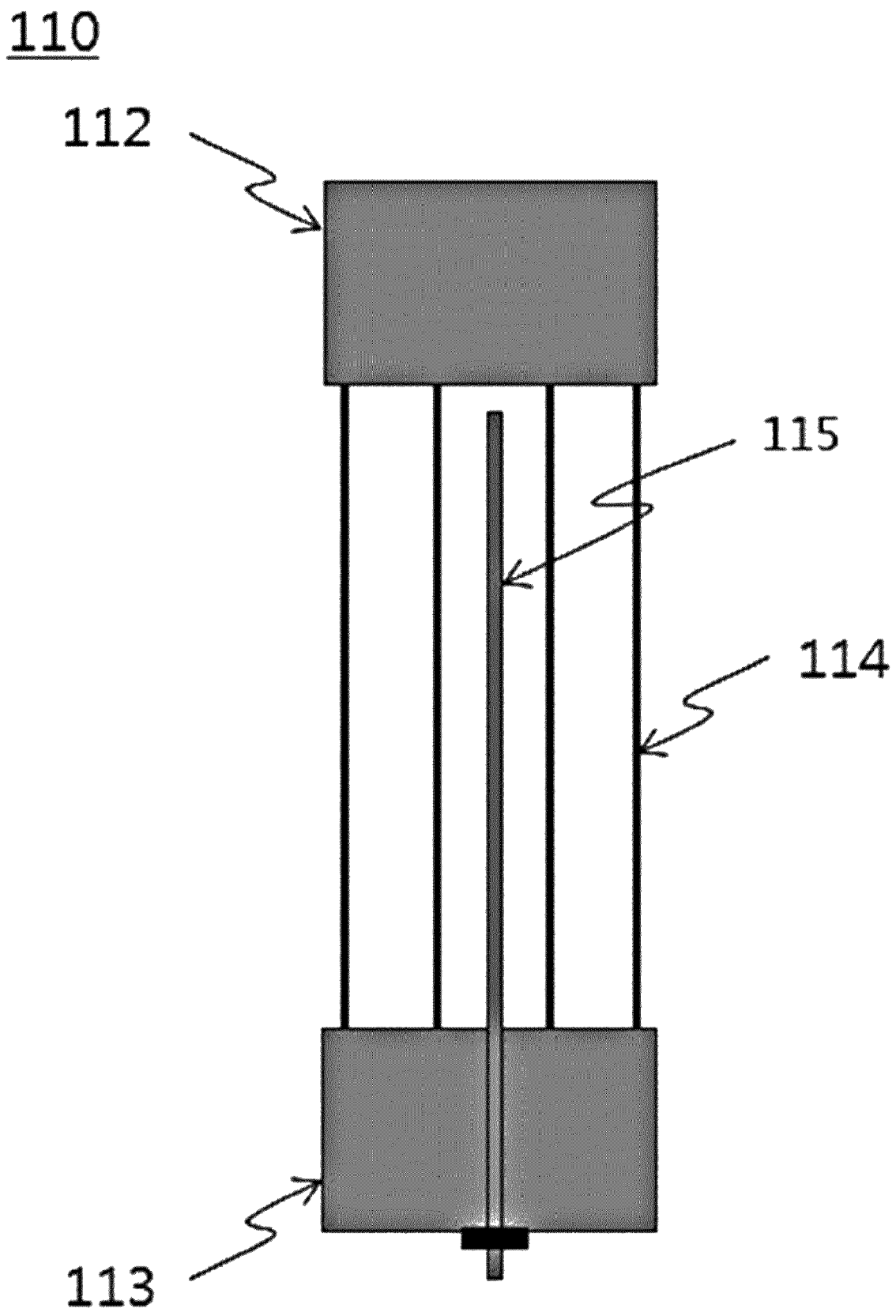
FIGS. 1 and 2 are schematic views illustrating a conductive filter unit 110 according to an embodiment of the present disclosure.
Figure 2:
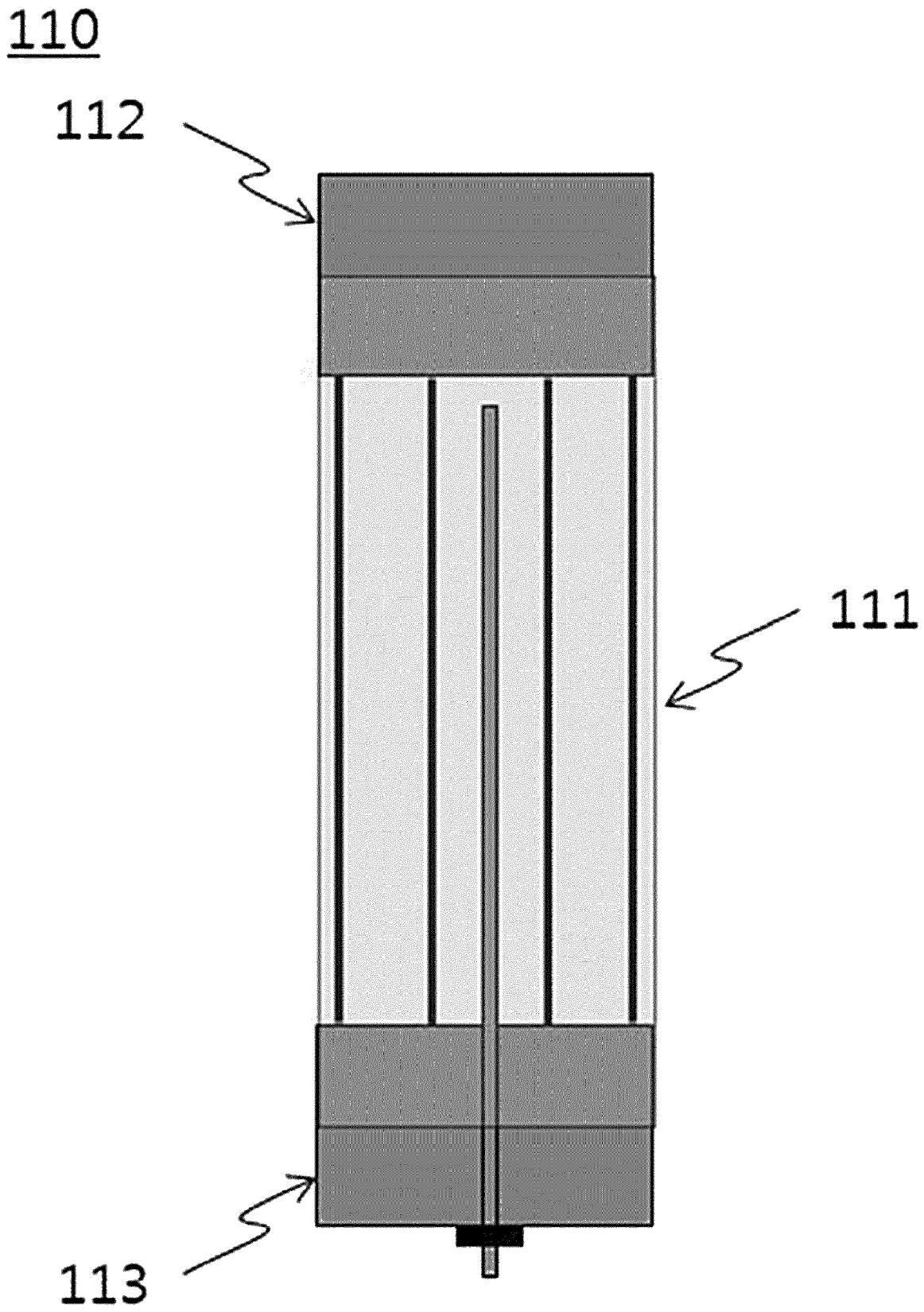

FIGS. 1 and 2 illustrate the conductive filter unit 110 configuring a conductive filter module 100 for collecting fine dust particles according to an embodiment of the present disclosure.

The conductive filter unit according to an embodiment of the present disclosure includes a first electrode cap; a second electrode cap; a conductive filter forming an internal space between the first electrode cap and the second electrode cap and electrically connected to the first electrode cap; and an electrode rod connected to the second electrode cap and forming an electric field in the internal space formed by the conductive filter.

In the present disclosure, as shown in FIGS. 1 and 2 of the accompanying drawings, it can be seen that the conductive filter unit 110 is included for highly efficient dust collecting using a conductive filter used for removing fine dust through a filtration method and an electric dust collecting method.

In order to efficiently collect fine dust through the conductive filter material, a conductive filter should be located in a relatively large area in a limited space, and it is common to use a bent filter in order to install the filter having a large area. Any material having a filter structure formed of a conductive material may be used as a material of the conductive filter 111.

For reference, the filter structure, as a structure including appropriate air pores and a support, refers to an object having a structure allowing a fluid including a particulate material to pass therethrough and allowing a portion or the entirety of the particulate material to be adhered to the support so as to be removed and the fluid to pass through the air pores so as to be discharged.

Preferably, in order to satisfy flexibility required for deformation such as bending of the conductive filter, a filter formed of polymer, natural thread, glass fiber, paper, and the like to ensure flexibility is coated with a conductive material so as to be provided, rather than a metal filter in a bulk state.

In addition, in order to collect fine dust with high efficiency through a conductive filter material, an area of an electrode formed of a highly conductive material in contact with a filter is preferably increased so that a voltage may be evenly applied to the entire region of the conductive filter, rather than a method of applying a voltage to one portion of the conductive filter.

The present disclosure may include the conductive filter unit 110 capable of implementing a large filtration area in a relatively narrow volume by winding the conductive filter 111 in a cylindrical shape having a predetermined diameter.

Specifically, the conductive filter unit 110 may include a first electrode cap 112; a second electrode cap 113; a plurality of supports 114 connecting the first electrode cap 112 and the second electrode cap 113; a conductive filter 111 connecting the first electrode cap and the second electrode cap, while forming a space therein and surrounding an outer circumferential surface of the support; and an electrode rod 115 protruding from a central portion of the second electrode cap into an internal space formed by the conductive filter.

In addition, the conductive filter unit 110 may include a first annular electrode cap 112 having an opening in a predetermined shape on one side of upper or lower portion of the conductive filter 111 to allow air containing fine dust to be introduced between the conductive filter 111 and the electrode rod 115 and a second electrode cap 113 having an electrode rod installed on the other side and hermitically closed not to allow air to be introduced therethrough.

In addition, an electrode formed of a conductive material may be installed at the first electrode cap 112 or the first electrode cap 112 itself may be formed of a conductive material so that a high voltage may be applied to the conductive filter 111. Preferably, the conductive filter 111 is wound to be in close contact with the first electrode cap 112 so as to be in contact with the electrode of the first electrode cap 112 to have a cylindrical shape, and the conductive filter 111 and the first electrode cap are attached by an adhesive material, so that a high voltage may be perfectly applied. Here, the air introduced into the conductive filter 111 is prevented from escaping between the first electrode cap 112 and the conductive filter 111.

In addition, the second electrode cap 113 serves to seal a lower portion of the conductive filter 111 and fix the electrode rod 115 and serves to closely fix the lower portion of the conductive filter 111. That is, like the first electrode cap 112, the lower portion of the conductive filter 111 is completely adhered and wound along the second electrode cap 113 and sealed and adhered by an adhesive material so that air does not escape between the second electrode cap 113 and the conductive filter 111.

According to an embodiment of the present disclosure, since the lower portion of the conductive filter 111 is sealed by the second electrode cap 113, the second electrode cap 113 may serve to fix the electrode rod 115. In this case, the second electrode cap 113 may be configured such that the conductive filter 111 and the electrode rod 115 are electrically shorted to form an electric field between the conductive filter 111 and the electrode rod 115.

In addition, the conductive filter unit 110 according to the present disclosure may include the support 114 connecting the first electrode cap 112 and the second electrode cap 113 and supporting the conductive filter and the cylindrical conductive filter wound around the support 114.

In collecting fine dust with high efficiency using the conductive filter 111 according to the present disclosure, air that enters the fine dust removal system 10 must entirely pass through the filter, and to this end, the filter and the support need to be attached closely so that air introduced into the filter may pass through the filter. Accordingly, the conductive filter 111 wound around the support 114 may be wound in a cylindrical shape and completely adhered with an adhesive material so that air does not leak between both ends of the filters that meet each other.

In addition, in the conductive filter unit 110, by placing the electrode rod 115 protruding into the internal space of the conductive filter 111 wound in a cylindrical shape from the center of the second electrode cap 113, a uniform electric field may be formed between the electrode rod 115 and an internal surface of the conductive filter 111.

An electric field between the conductive filter 111 and the electrode rod 115 plays a key role of allowing fine dust introduced into the conductive filter 111 to be efficiently collected in the conductive filter by the electric field.

In order to form a uniform electric field between the conductive filter 111 and the electrode rod 115, an electrode should be formed at the first electrode cap 112 so that a high voltage may be applied to the conductive filter 111, and the electrode rod 115 protruding into the internal space of the conductive filter 111 should be formed such that a voltage having a polarity opposite to that of the voltage applied to the filter is applied to the electrode rod 115 or may be grounded.

Next, the electrode rod 115 of the present disclosure will be described.

Figure 3:
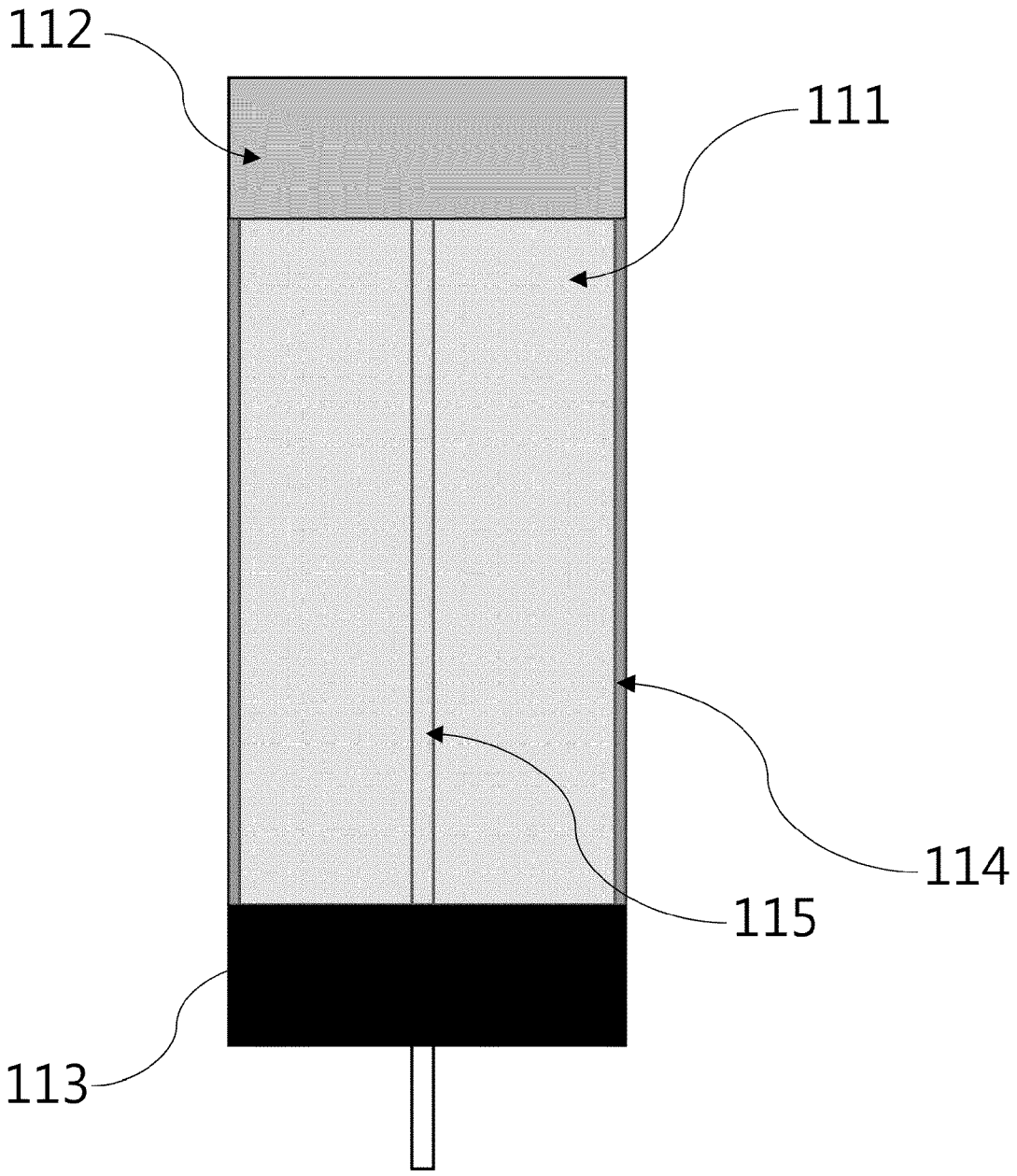
FIGS. 3 and 4 are schematic views illustrating an electrode rod 115 including a carbon member 115*b* disposed on a portion of a surface of a conductive member 115*a* and a conductive filter unit 110 including the same according to an embodiment of the present disclosure.
Figure 4:
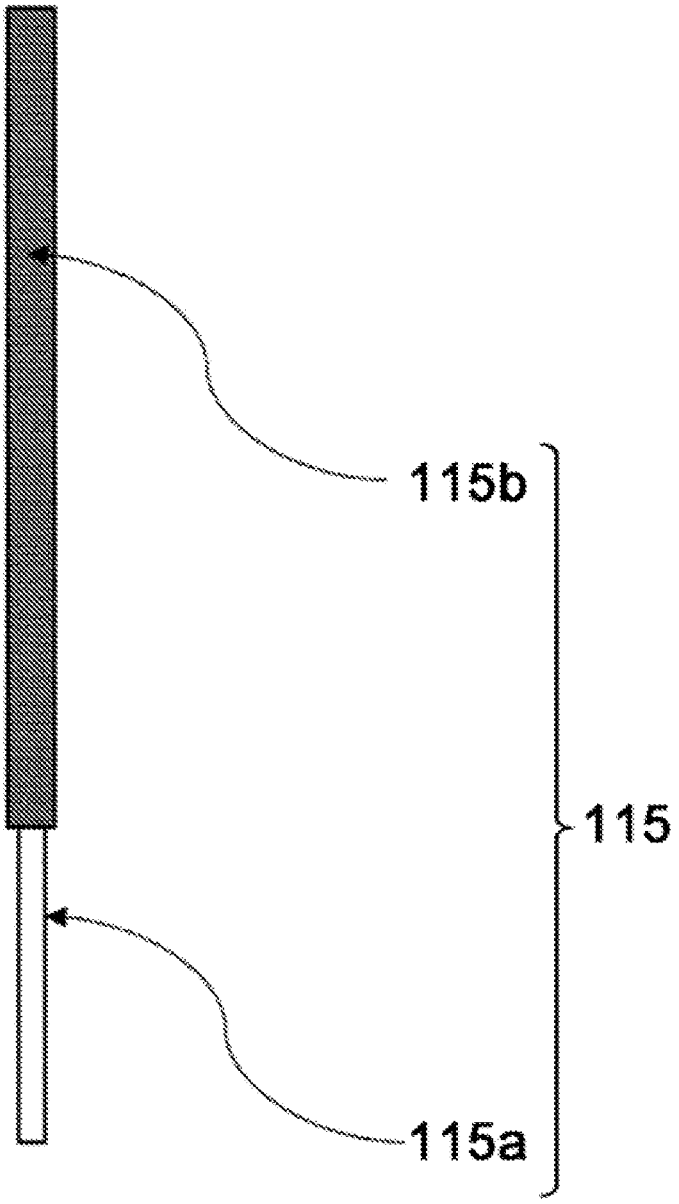

As illustrated in FIGS. 3 and 4, the electrode rod 115 may include a conductive member 115*a* protruding from the second electrode cap into the internal space formed by the conductive filter 111 and a carbon member 115*b* disposed on at least a portion of a surface of the conductive member 115*a*.

The carbon member 115*b* disposed on a portion of the surface of the conductive member 115*a* may be a carbon fiber and a powdery carbon fiber for generating a large amount of ions between an ionizer and the conductive filter. The fiber may have an average longitudinal length of 1 mm (millimeter) to 300 cm (centimeter), and the powdery carbon fiber may have an average particle diameter of 1 um (micrometer) to 1000 um.

In the case of the conductive filter unit using the electrode rod 115 having the carbon member 115*b* disposed on the surface of the conductive member 115*a*, a high voltage having the same polarity as that of a high voltage applied to an ionizing unit is applied to the conductive member 115*a* and a voltage having a polarity opposite to the polarity of the high voltage applied to the conductive member 115*a* or a ground is applied to the conductive filter.

When a separate ionizing unit is not used, a negative or positive high voltage is applied to the electrode rod 115 in which the carbon member 115*b* disposed on the surface of the conductive member 115*a* and a high voltage having a polarity opposite to that of the high voltage applied to the electrode rod 115 or the ground is applied to the conductive filter.

The conductive filter unit using the conductive member 115*a* in which the carbon member 115*b* is disposed on the surface thereof as the electrode rod 115 may also play a role of improving a charge rate of fine dust particles by inducing generation of a large amount of ions as well as the role of forming an electric field inducing charged particles to be easily collected in the conductive filter. In particular, ions are generated between the conductive member 115*a* and the conductive filter and move from the conductive member to the conductive filter, and here, fine dust particles move in a direction perpendicular to the movement path of the ions, and thus, a probability of collision with ions may be improved to rapidly improve a particle charge rate. In addition, due to the collision with ions, the movement direction of the fine dust particles is changed to the conductive filter direction, so that collection efficiency by the electrostatic force may also be significantly improved.

According to an embodiment of the present disclosure, when the conductive filter is grounded, without applying a voltage to the electrode rod, using a cylindrical filter module including an electrode rod in which a carbon member is not disposed on the surface thereof without a separate ionizer, a fine dust removal rate was 6.7% on average. Meanwhile, in a cylindrical filter module including an electrode rod in which a carbon member cut to have a length of 0.5 cm to 7 cm, a carbon member cut to have a length of 1 mm to 3 mm, and powdery carbon having a particle size of 10 um to 30 um are disposed, when a high DC voltage of −1 kV to −6 kV is applied to the electrode rod and the conductive filter is grounded, a fine dust removal efficiency was measured to be 90 to 100%, exhibiting excellent fine dust removal efficiency.

Hereinafter, the conductive filter module 100 of the present disclosure will be described.

Figure 5:
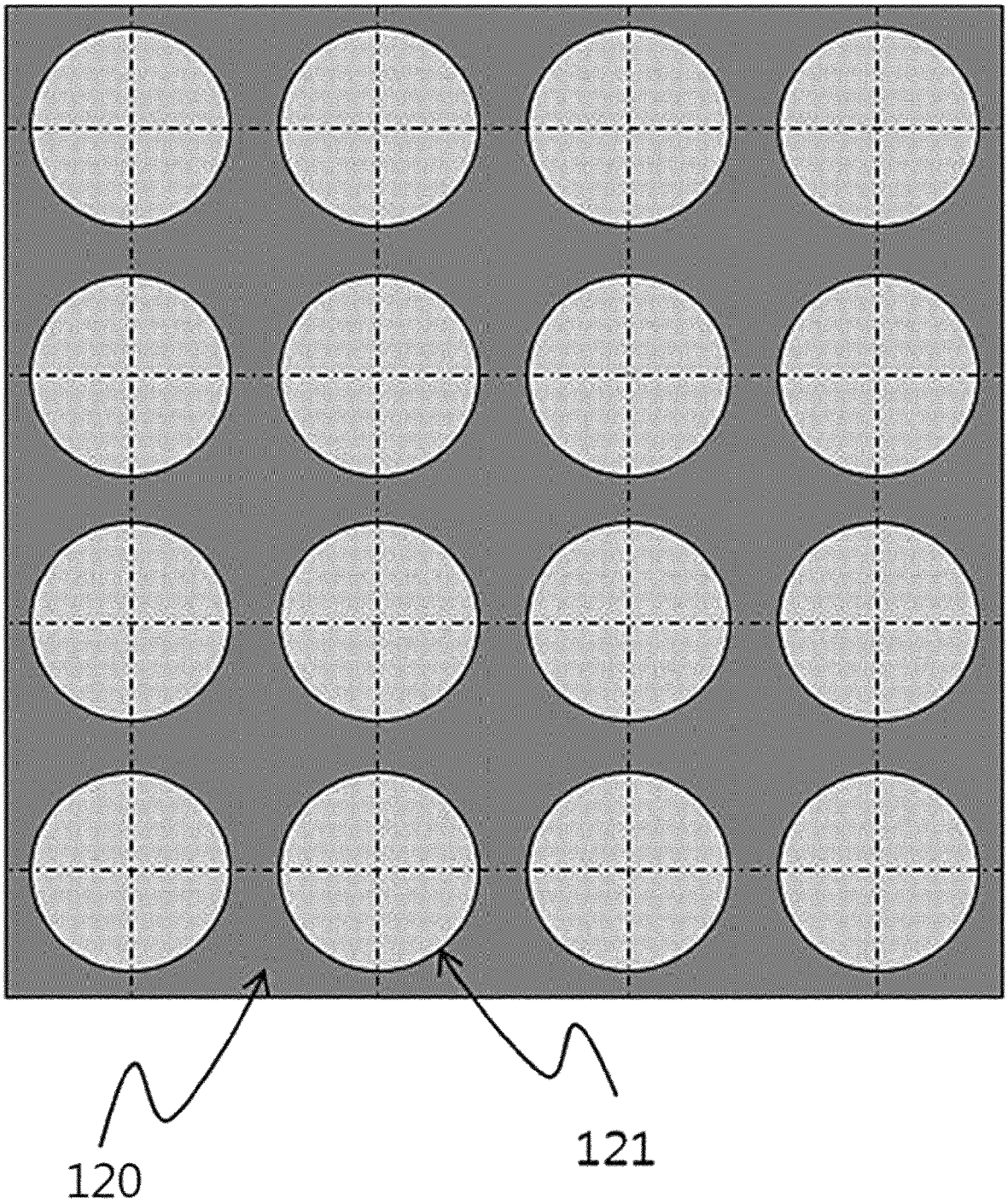
FIGS. 5 and 6 are schematic views illustrating a shape of an upper fixing plate configuring a conductive filter module 100 according to an embodiment of the present disclosure.
Figure 6:
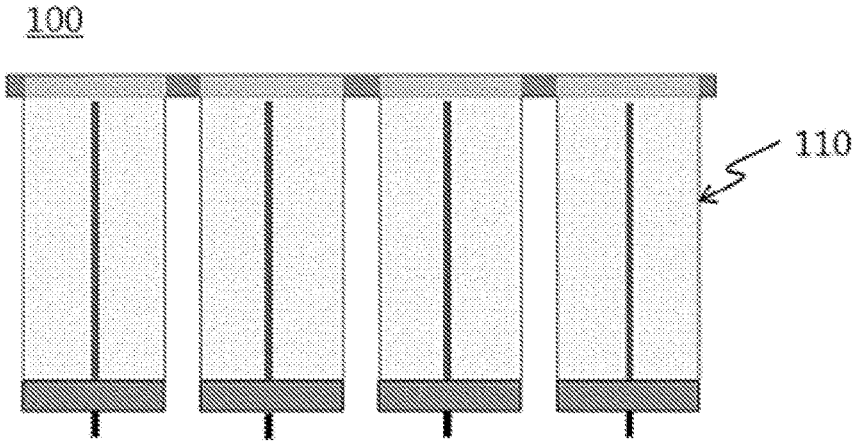

As shown in FIGS. 5 and 6, the conductive filter module 100 may include a filter fixing plate 120 to allow a plurality of conductive filter units 110 to be mounted and fixed thereon.

The filter fixing plate 120 may include as many air inlets 121 as the number of the conductive filter units 110 to be connected in order to mount the conductive filter units 110.

The air inlet 121 has a structure in which the first electrode cap 112 of the conductive filter unit 110 is connected thereto, and the conductive filter 111, the first electrode cap 112, and the filter fixing plate 120 may not be electrically shorted so that a high voltage may be applied to the conductive filter 111.

Figure 7:
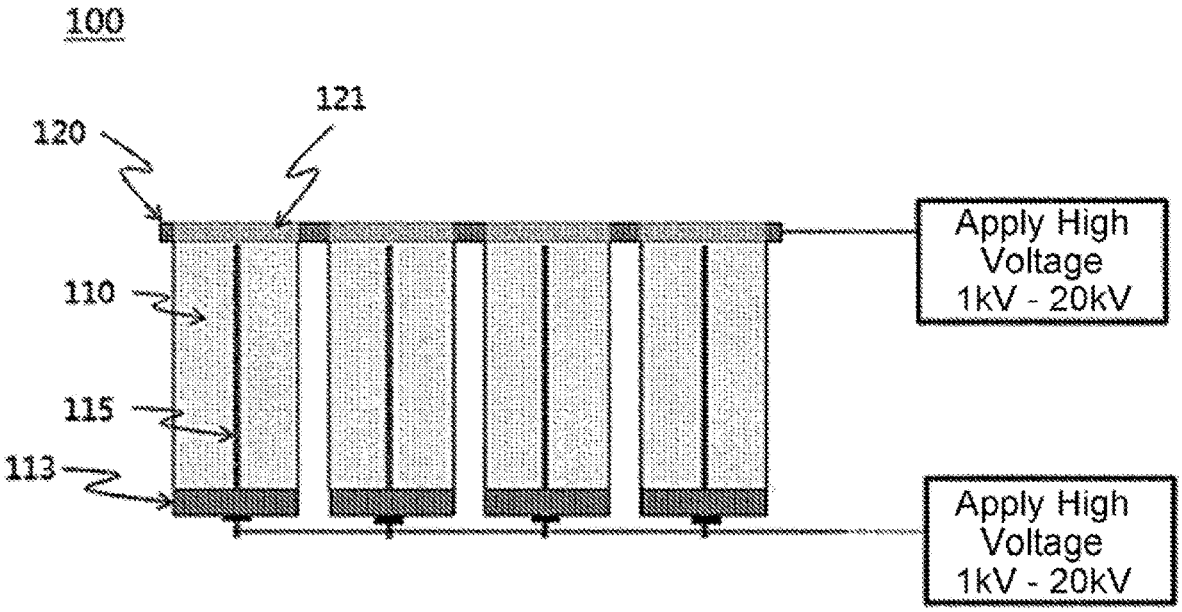
FIGS. 7 and 10 illustrate a way in which a high voltage is applied to the conductive filter module 100 according to an embodiment of the present disclosure.
Figure 8:
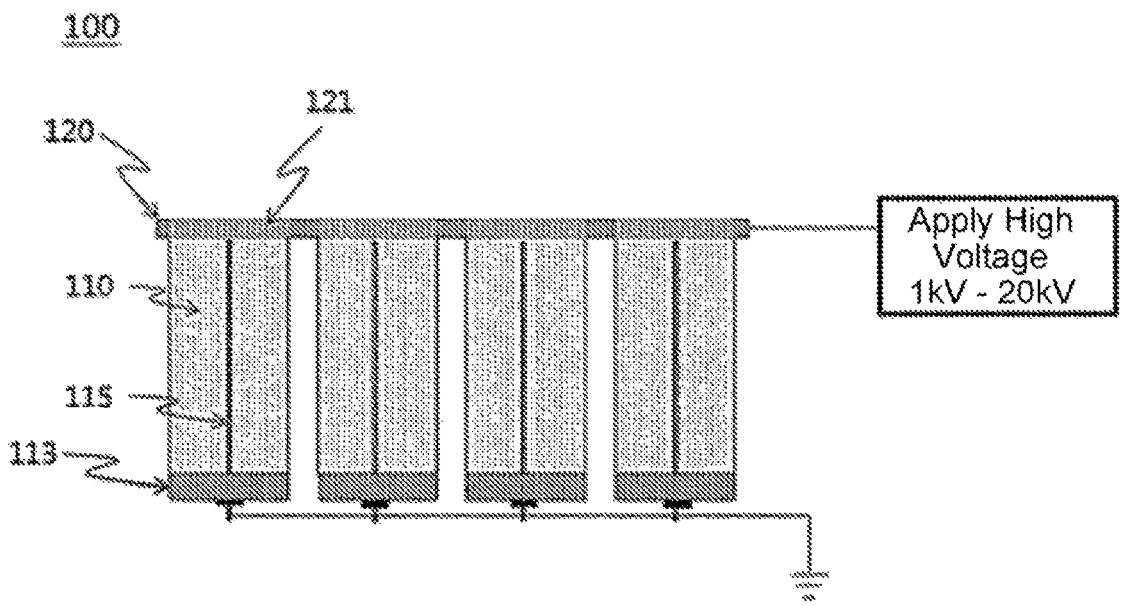
Figure 10:
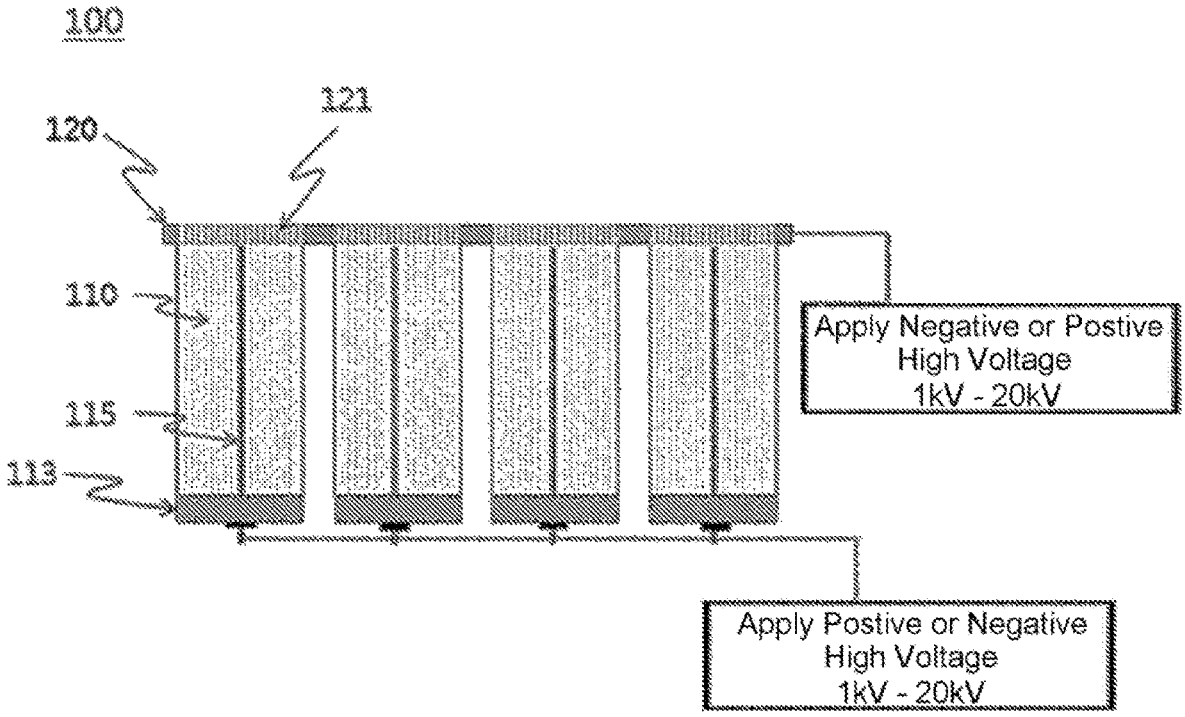
Figure 11:
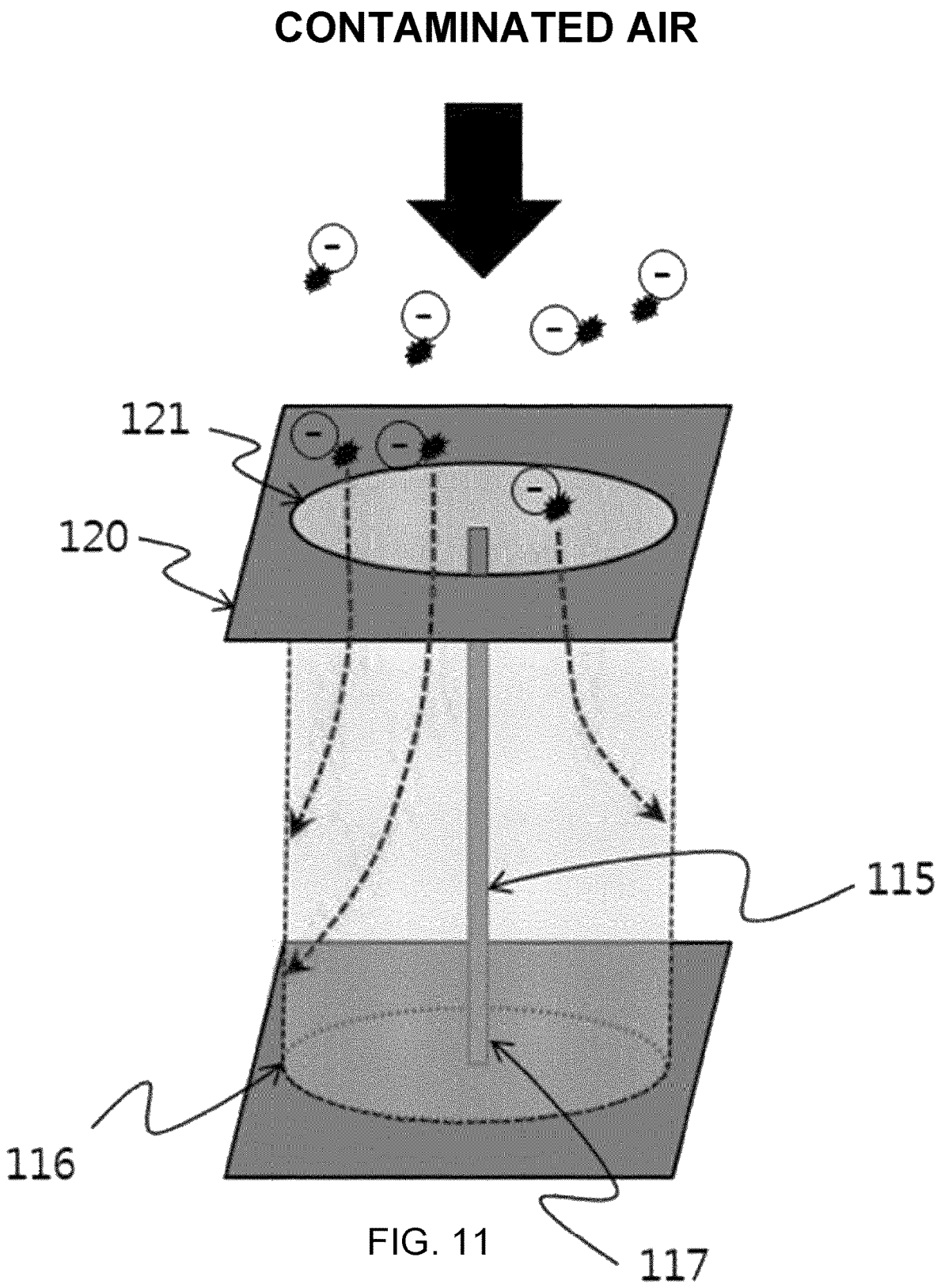
FIGS. 11 and 14 illustrate a mechanism for collecting fine dust when the fine dust is introduced into the conductive filter unit 110 according to an embodiment of the present disclosure.
Figure 12:
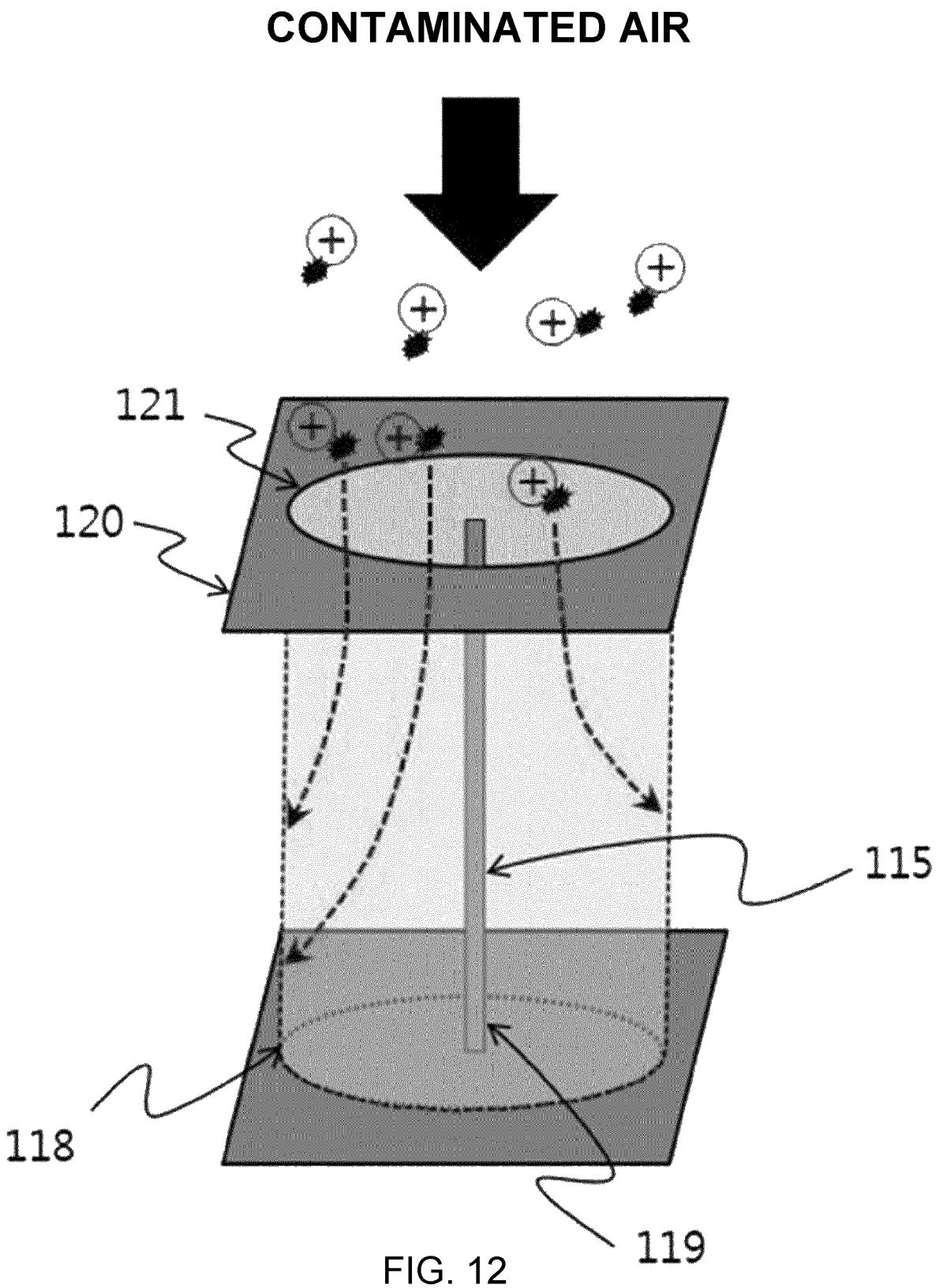
Figure 13:
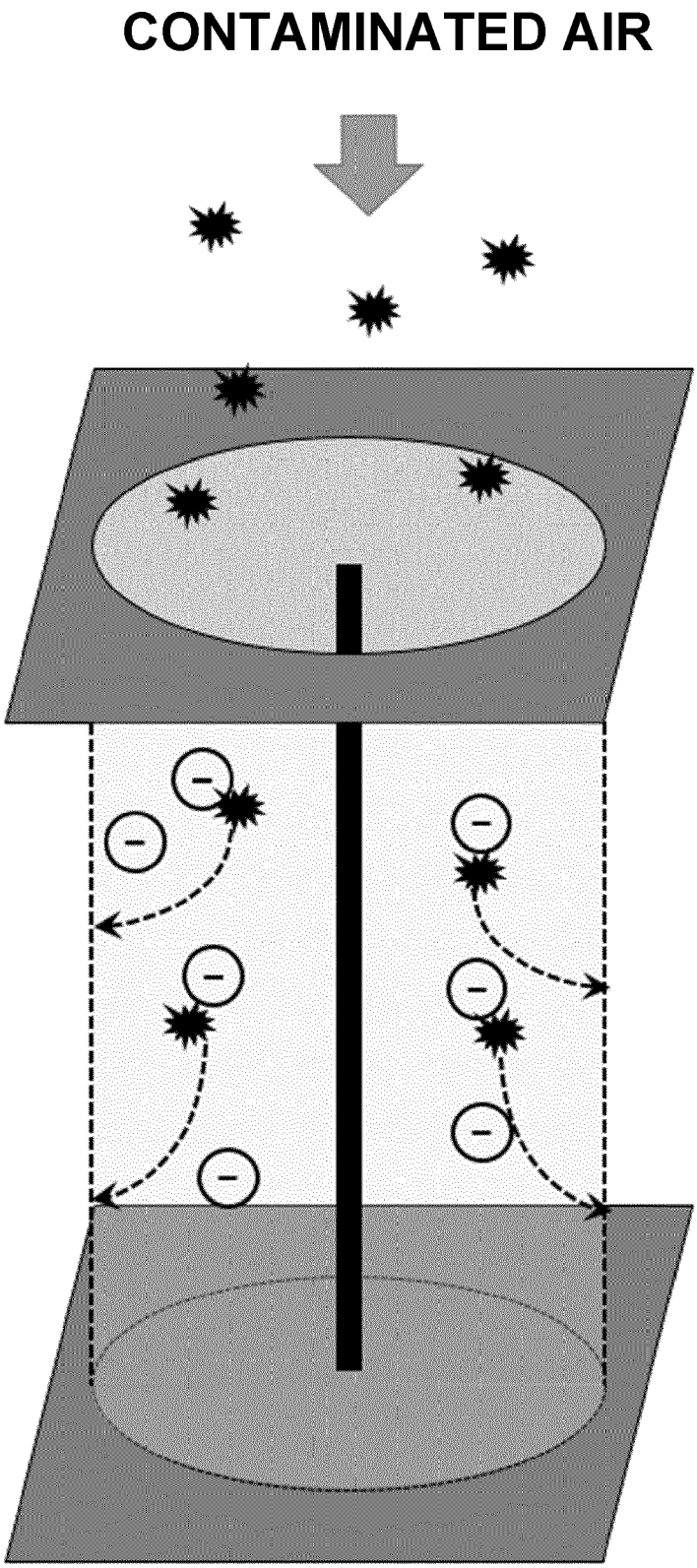

FIGS. 7 and 10 illustrate a way in which a high voltage is applied to the conductive filter modules 100 including the filter fixing plate 120 on which the plurality of conductive filter units 110 are mounted according to an embodiment of the present disclosure.

In the present disclosure, a high voltage of 1 to 20 kV is applied to the conductive filter module 100 to form an electric field required for removing fine dust. The filter fixing plate 120, the first electrode cap 112, and the conductive filter 111 are connected to each other and are not electrically shorted so that a high voltage is applied to the conductive filter 111. In addition, the electrode rod 115 may be grounded or a high voltage having a polarity opposite to that of a voltage applied to the filter fixing plate 120 may be applied to the electrode rod 115 to form a uniform electric field between the conductive filter 111 and the electrode rod 115.

Meanwhile, in the case of using the electrode rod 115 in which the carbon member 115*b* is disposed on the surface of the conductive member 115*a*, the conductive filter 111 may be grounded or a high voltage having a polarity opposite to that of a voltage applied to the electrode rod 115 is applied to the conductive filter 111 to generate a large amount of ions from the conductive member 115*a* and simultaneously strengthen an electric field between the conductive filter and the electrode rod to maximize a collection rate of the fine dust particles on the conductive filter.

Figure 9:
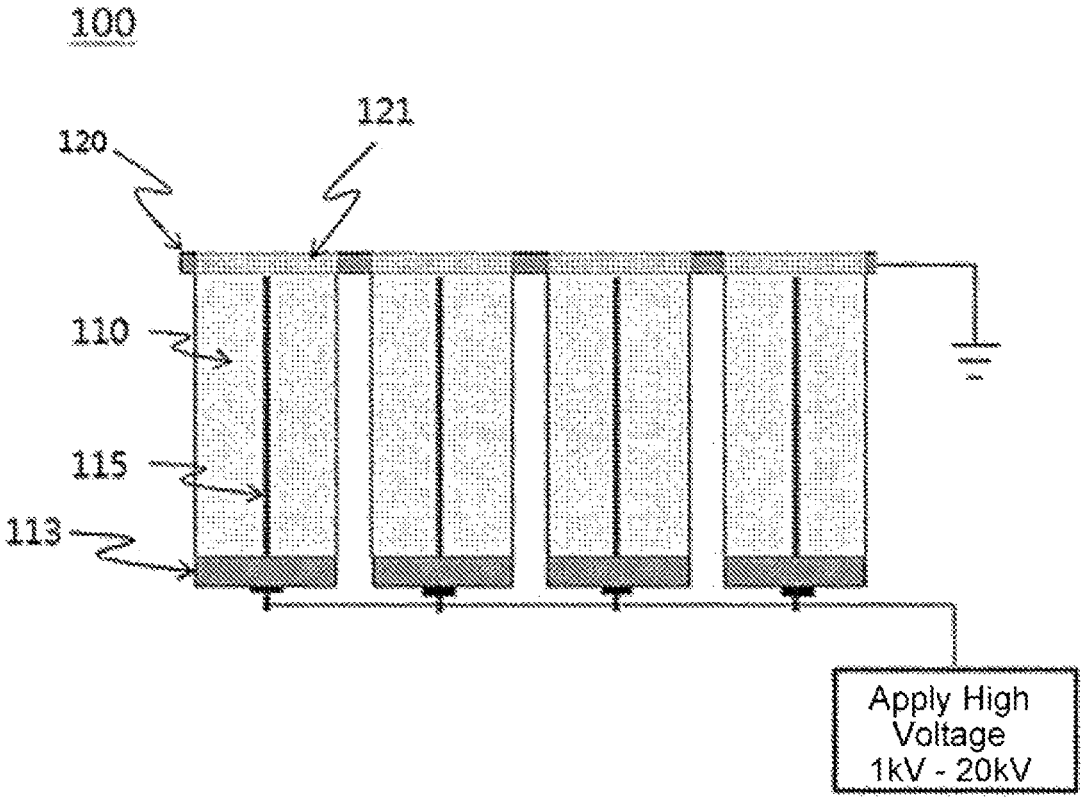
Figure 14:
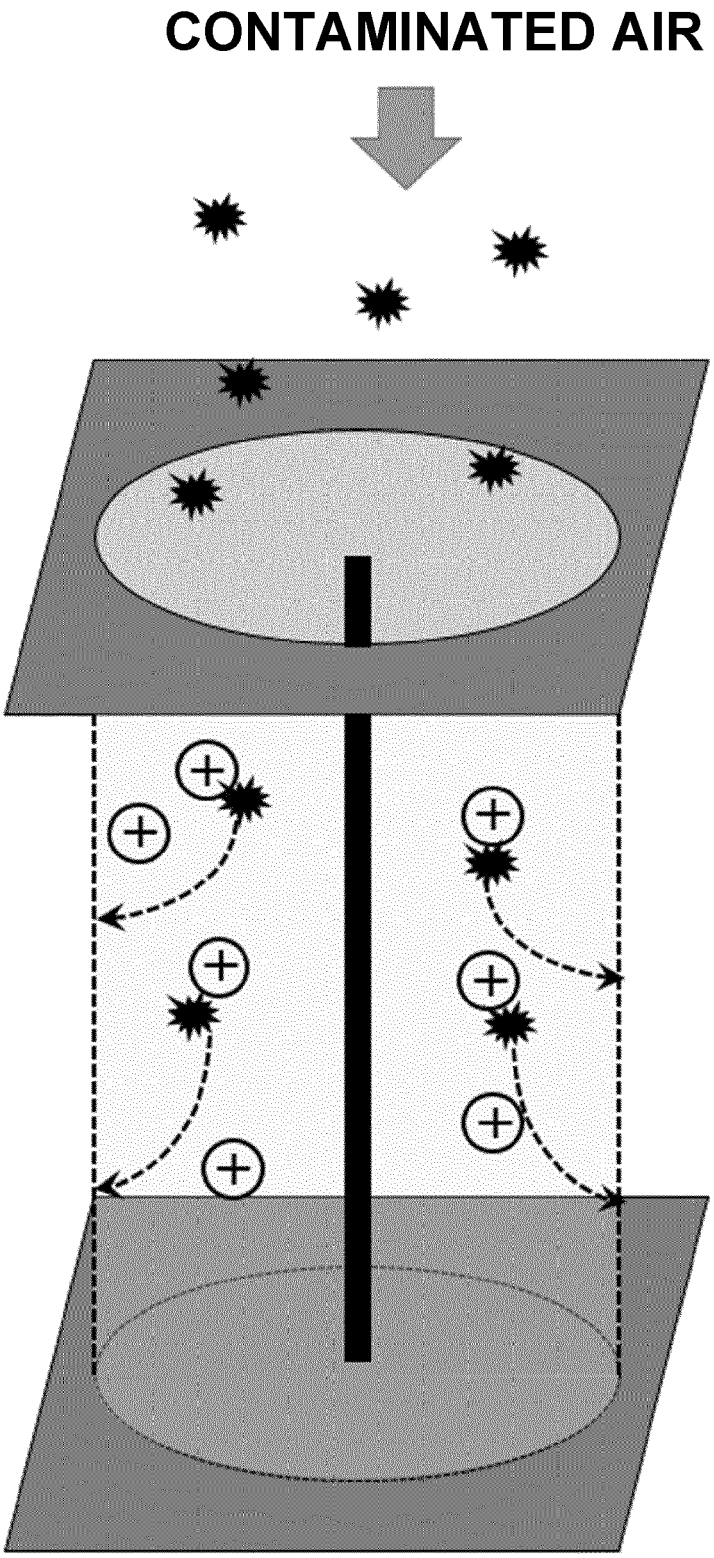
Figure 15:
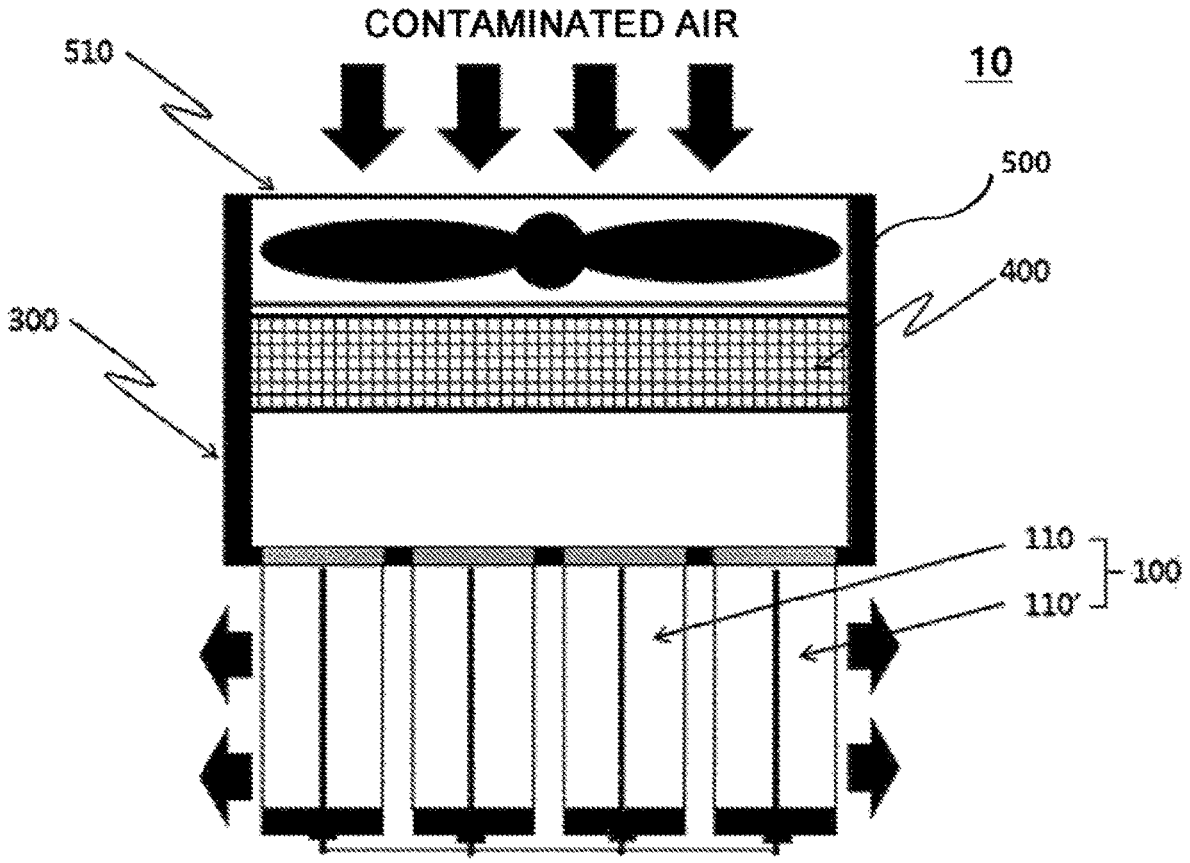
FIGS. 15 to 18 are schematic views illustrating the fine dust removal system 10 according to another embodiment of the present disclosure.

FIGS. 9 and 14 illustrate a mechanism for collecting fine dust when the fine dust flows into the conductive filter unit 110 according to an embodiment of the present disclosure.

In the present disclosure, when fine dust flows into the conductive filter unit 110, fine dust particles charged with a polarity opposite to a polarity 116 or 118 of the voltage applied to the conductive filter in an electric field area formed between an inner wall of the conductive filter 111 and the electrode rod 115 may pass through the conductive filter 111 in a filter dust collection and electric precipitation mechanism so as to be collected on surfaces of unit fibers configuring the conductive filter.

In addition, since a polarity 117 or 119 of a voltage having the same polarity as that of the fine dust particles is applied to the electrode rod, the fine dust particles charged with the same polarity may pass through the conductive filter 111 in the filter dust collection and electric precipitation mechanism so as to be collected on the surfaces of the unit fibers configuring the conductive filter.

Thus, in the conductive filter module 100 according to an embodiment of the present disclosure, it is very important to cause contaminated air containing fine dust to flow in through the first electrode cap 112 to which the conductive filter 111 is connected and to cause the fine dust to flow into the electric field area formed between the conductive filter 111 and the electrode rod 115.

Hereinafter, the fine dust removal system 10 including the conductive filter module 100 of the present disclosure will be described.

In addition, the fine dust removal system including the conductive filter module 100 of the present disclosure generates a large amount of ions when a high voltage is applied thereto by using the electrode rod 115 in which the carbon member 115*b* is disposed on a surface of the conductive member 115*a*, and thus, the fine dust removal system 10 may not include an ionizer.

As described above, in the present disclosure, it is very important to cause contaminated air containing fine dust to flow in and to cause the fine dust to flow into the electric field area formed between the conductive filter 111 and the electrode rod 115. To this end, in an embodiment of the fine dust removal system 10 of the present disclosure, a pressing blower 510 is located above the first electrode cap 112 of the conductive filter module 100 and a housing 300 of an sealed structure may be installed therearound in order to prevent air outflow and inflow.

The contaminated air containing fine dust flows into the channel leading to the conductive filter module 100 through the pressing blower 510. Here, the fine dust existing in the introduced air is electrically charged, while passing through an ionizer 400. The air containing the charged fine dust entirely flows to between the conductive filter 111 and the electrode rod 115 through the first electrode cap 112 by the housing 300 formed by an sealed wall between the pressing blower 510 and the filter fixing plate 120 fixing the conductive filter unit 110, and most of the introduced charged fine dust is collected to the inner wall of the conductive filter. In this case, a functional filter for removing gaseous contaminants or odors existing in the air may be additionally installed at a front end or a rear end of the ionizer 400. Here, the rear end refers to all the portions at the rear end of the ionizer 400 with reference to a flow direction of air.

Figure 16:
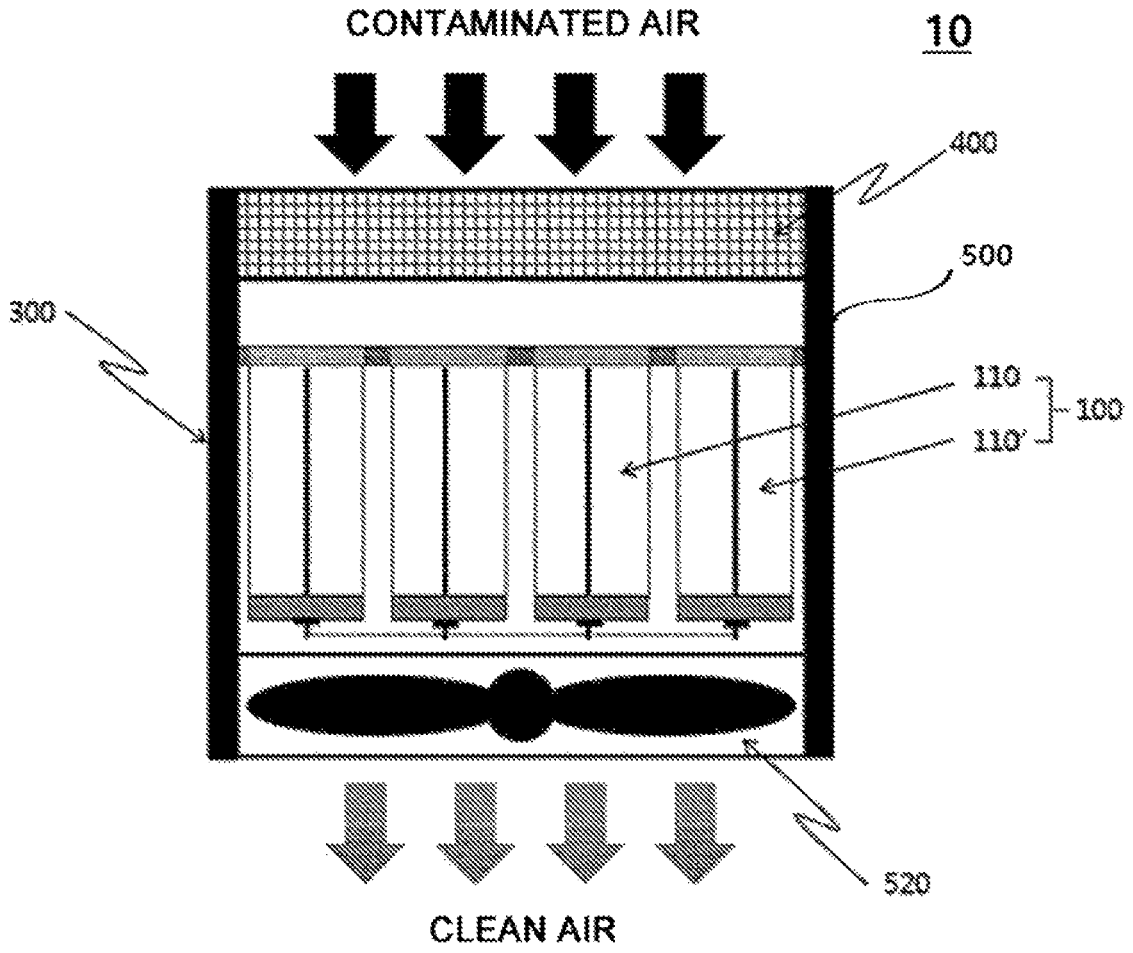

In another embodiment of the fine dust removal system 10 including the conductive filter module 100 of the present disclosure, as shown in FIG. 16, an inducing blower 520 may be located below the second electrode cap 113 and the housing 300 of an sealed structure may be installed therearound in order to prevent air outflow and inflow.

In addition, the housing 300 of the sealed structure may extend to be connected to the ionizer 400 so that the contaminated air containing fine dust may pass through the ionizer 400.

Here, in the case of driving the inducing blower 520, the inside of the housing 300 of the sealed structure may be maintained at a negative pressure so that the contaminated air containing fine dust may flow into the ionizer 400 communicating with the outside. Here, the fine dust present in the contaminated air is electrically charged, while passing through the ionizer 400.

The contaminated air containing charged fine dust entirely flows between the conductive filter 111 and the electrode rod 115 through the first electrode cap 112 by the housing 300 of the sealed structure, and most of the charged fine dust is connected to the inner wall of the conductive filter. Here, a functional filter (not shown) for removing gaseous contaminants, odors, etc., present in the air may be additionally installed at the front end or the rear end of the ionizer 400.

Figure 17:
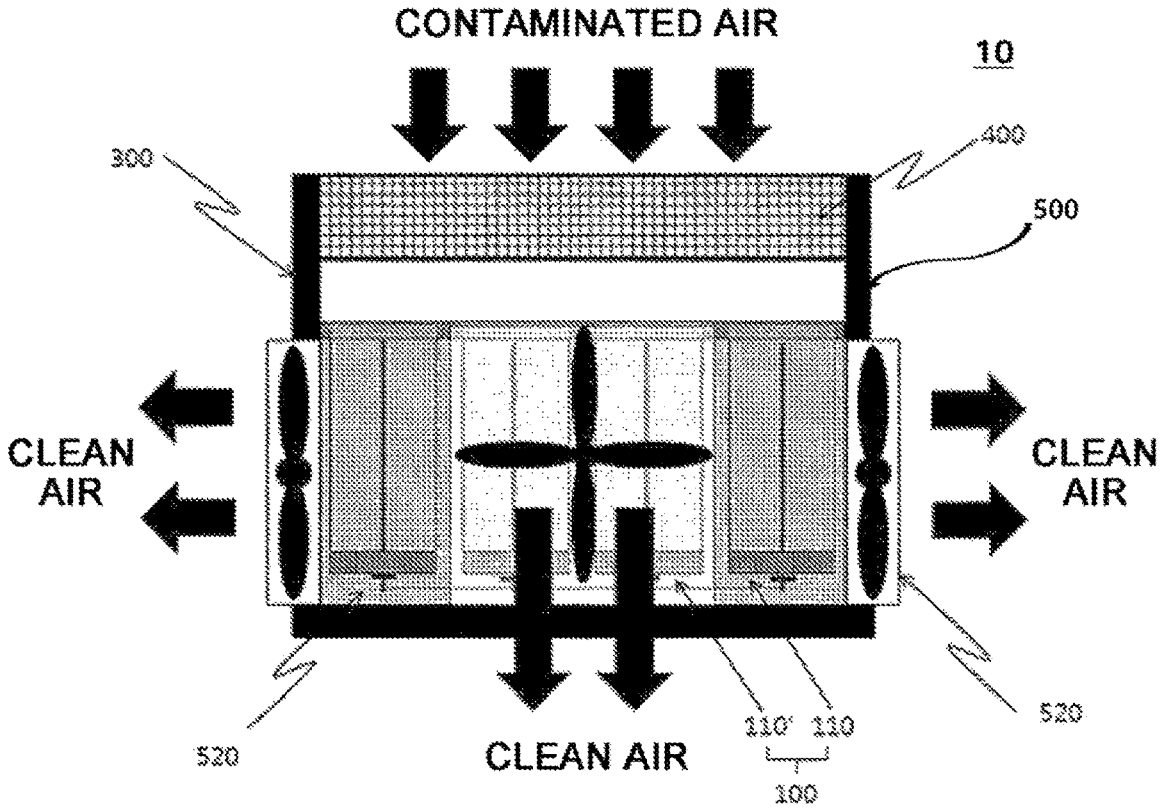

In another embodiment of the fine dust removal system 10 including the conductive filter module 100 of the present disclosure, as shown in FIG. 17, an inducing blower 520 may be located on each side of a quadrangular module in which the conductive filters 111 are arranged in four directions, and the housing 300 of an sealed structure may be installed at a portion not blocked by the inducing blower to prevent air outflow and inflow.

In addition, the housing 300 of a structure capable of sealing the periphery of the ionizer 400 may be installed at the air inlet 121 so that air may entirely flow in through the ionizer 400.

In this case, in the case of driving the inducing blower 420, air containing fine dust flows into the ionizer 400 maintained at a negative pressure and communicating with the outside in the housing 300 of the sealed structure. Here, the fine dust existing in the introduced air is electrically charged, while passing through the ionizer 400. The air containing charged fine dust is entirely introduced between the conductive filter 111 and the electrode rod 115 through the first electrode cap 112 by the housing 300 of the sealed structure, and most of the charged fine dust is collected in the inner wall of the conductive filter. In this case, a functional filter for removing gaseous contaminants or odors existing in the air may be additionally installed at the front end or the rear end of the ionizer 400.

Figure 18:
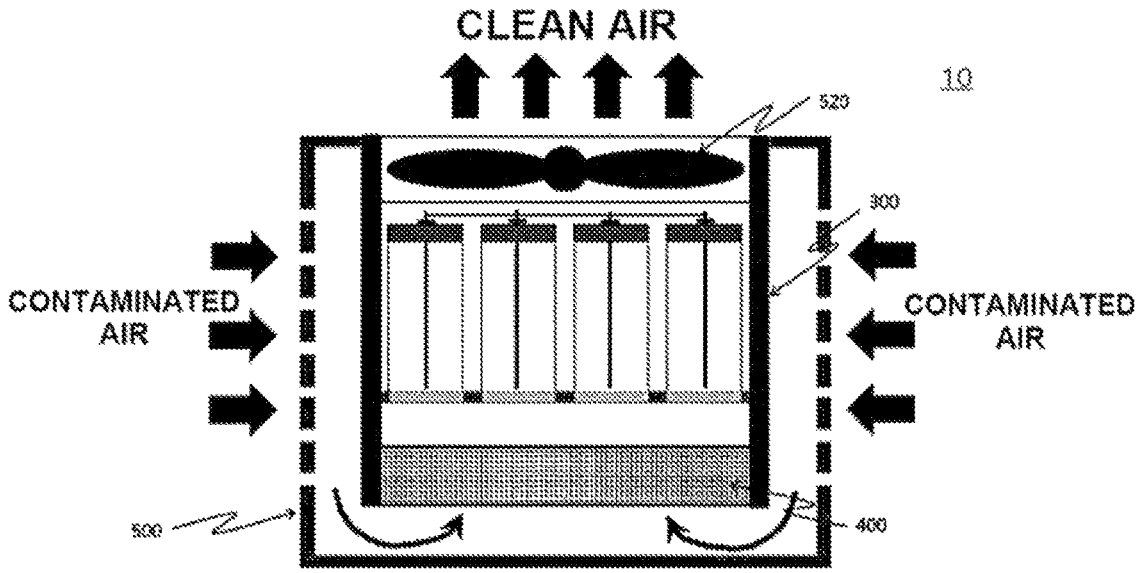

In another embodiment of the fine dust removal system 10 including the conductive filter module 100 of the present disclosure, as shown in FIG. 18, the inducing blowers 520 are located to be spaced apart from each other on an upper side of a quadrangular module in which the conductive filters 111 are arranged and the ionizer 400 is located to be spaced apart on a lower side, and in this state, the housing 300 of a sealed structure for blocking air outflow and inflow and an external housing 500 covering the outside of the housing 300 may be further provided at a path between the conductive filter 111 and the inducing blower 520 and between the conductive filter 111 and the ionizer 400.

Here, in the structure of the quadrangular module in which the conductive filters 111 are arranged, the first electrode cap 112 may be located at the upper portion and the second electrode cap 113 may be located at the lower portion or the first electrode cap 112 may be located at the lower portion and the second electrode cap 113 may be located at the upper portion.

Figure 19:
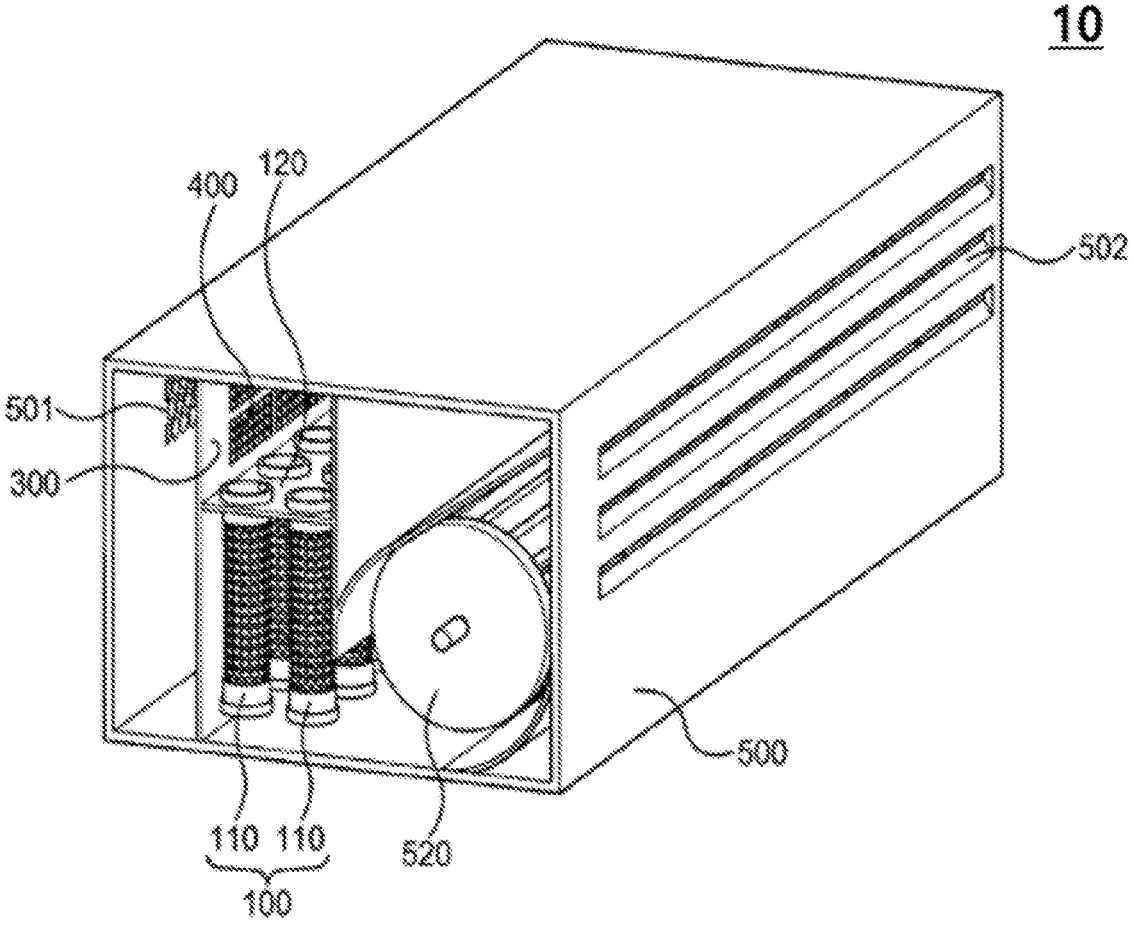
FIGS. 19 to 21 are schematic views illustrating the fine dust removal system 10 according to another embodiment of the present disclosure.
Figure 20:
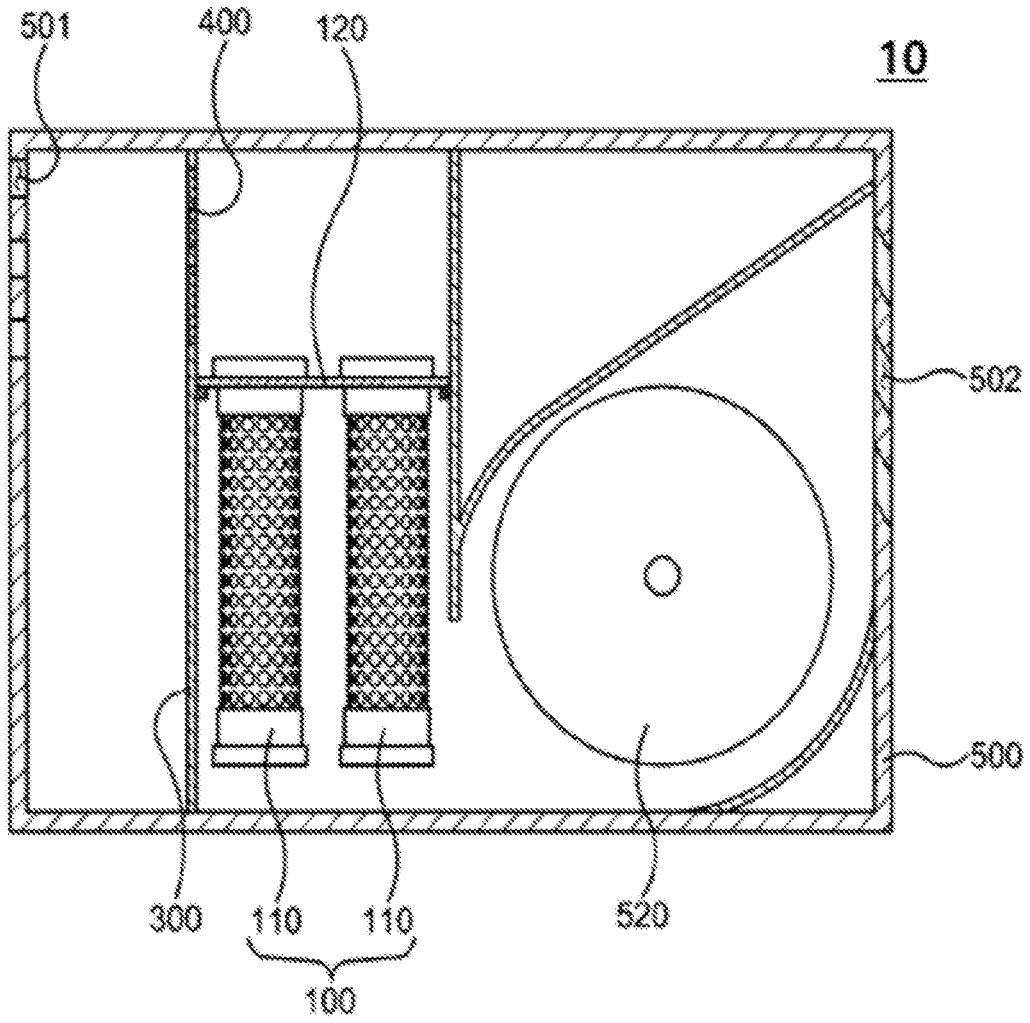
Figure 21:
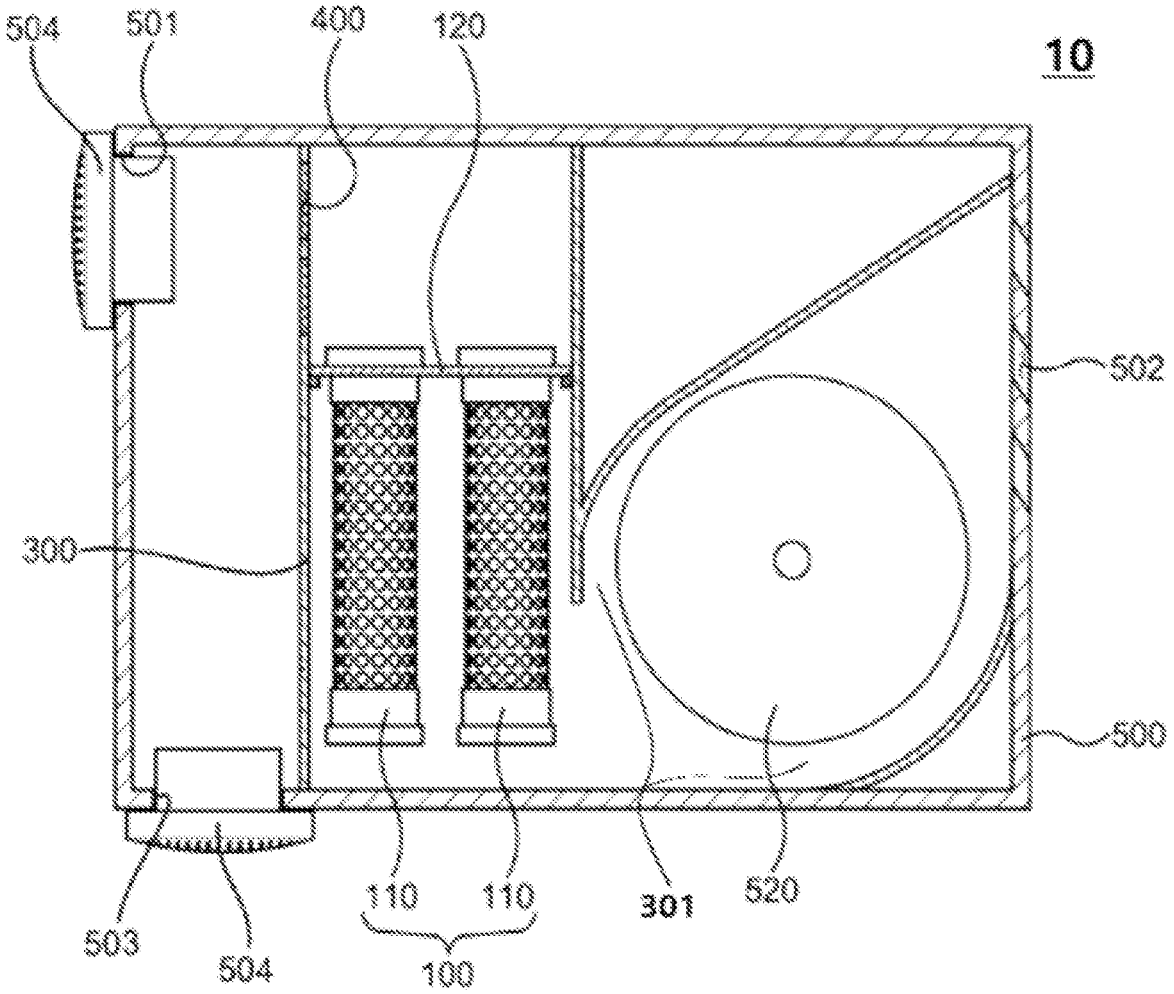

As shown in FIGS. 19 to 21, another embodiment of the fine dust removal system 10 including a conductive filter module of the present disclosure may include: a housing 300; an ionizer 400 disposed in a contamination air inflow or clean air outlet direction of the housing 300; a conductive filter module 100 including a plurality of conductive filter units 110 disposed to face each other and spaced apart from the ionizer 400; and a pressing blower 510 or an inducing blower 520 disposed in the contamination air inflow or clean air outlet direction of the housing 300 to induce a flow of air.

In this case, the ionizer 400 may be disposed and fixed in the contaminated air inflow direction of the housing 300 and the conductive filter module 100 may be disposed and fixed in the clean air outlet direction. Conversely, the ionizer 400 may be disposed in the clean air outlet direction of the housing 300 and the conductive filter module 100 may be disposed and fixed in the contaminated air inflow direction.

In addition, the pressing blower 510 may be disposed and fixed in the contaminated air inflow direction of the housing 300, the inducing blower 520 may be disposed and fixed in the clean air outlet direction, and only the inducing blower 520 may be disposed and fixed in the clean air outlet direction.

In addition, only the pressing blower 510 may be disposed in the contaminated air inflow direction or only the inducing blower 520 may be disposed and fixed in the clean air outlet direction.

In addition, the housing 300 in which the ionizer 400, the conductive filter module 100, the pressing blower 510, or the inducing blower 520 are disposed may be vertically disposed at an intermediate portion in the external housing 500 in the form of a case provided with a contaminated air inlet 501 and a clean air outlet 502. That is, the fine dust removal system 10 of the present disclosure may be packaged by the external housing 500.

In this case, one surface of the housing 300 may form a partition to form a space with one inner wall where the contaminated air inlet 501 of the external housing 500 is provided, and the other surface of the housing 300 may form a partition to form a space with the other inner wall where the clean air outlet 502 of the external housing 500 is provided, and a communicating path 301 may be formed at a lower portion. The ionizer 400 may be provided at an upper portion of one surface of the housing 300 corresponding to the contaminated air inlet 501, the conductive filter module 100 is disposed and fixed directly down from an inner middle portion of the housing 300, and the inducing blower 520 may be provided in a space between a communicating portion at a lower side of the other surface of the housing 300 and the clean air outlet 502.

In this case, in the embodiment, a door member 503 through which the indoor contaminated air may be introduced is additionally installed at a lower portion of the space between the outdoor contaminated air inlet 501 and the housing 300, the outdoor contaminated air inlet 501 is connected to the outdoor area to allow outdoor air to flow in therethrough, and the door member 503 through which the indoor contaminated air may be introduced is connected to the indoor area to allow the indoor contaminated air to flow therethrough. An automatic damper 504 may be installed at each of the outdoor contaminated air inlet 501 and the door member 503 through which indoor contaminated air may be introduced, so that outdoor contaminated air and indoor contaminated air may be selectively introduced.

Here, the pressing blower 510 may be further provided in a space between the contaminated air inlet 501 and the ionizer 400.

Here, the pressing blower 510 or the inducing blower 520 may also be provided in a duct for concentratively guiding the flow of air.

In the present disclosure as described above, in the case of driving the inducing blower 520, contaminated air including fine dust flows through the contaminated air inlet 501 of the external housing 500, and as the contaminated air passes through the ionizer 400 located on an upper portion of one surface of the housing 300, fine dust is electrically charged.

The contaminated air including the fine dust charged as described above is entirely introduced between the conductive filter 111 and the electrode rod 115 through the first electrode cap 112 by the housing 300 of the sealed structure, and most of the charged fine dust is collected on the inner wall of the conductive filter and only clean air is discharged to the clean air outlet 502 through the inducing blower 520.

In this case, it is also preferable to additionally install a functional filter for removing gaseous contaminants, odors, etc. existing in the air at the front end or the rear end of the ionizer 400.

An installation application example of the fine dust removal system 10 of the present disclosure as described above will be described.

Figure 22:
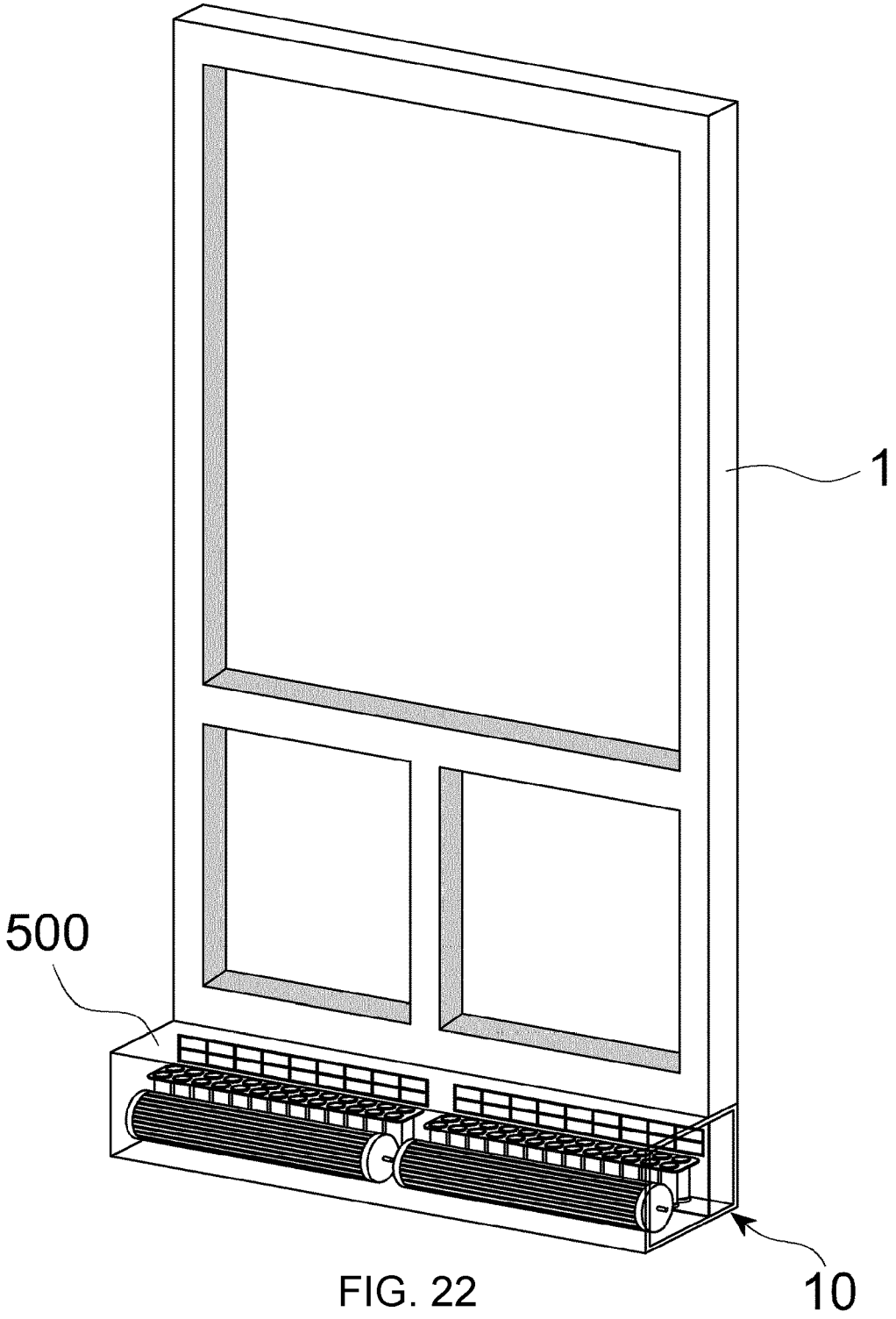
FIGS. 22 to 24 are views illustrating a state in which the present disclosure is installed in a window.
Figure 23:
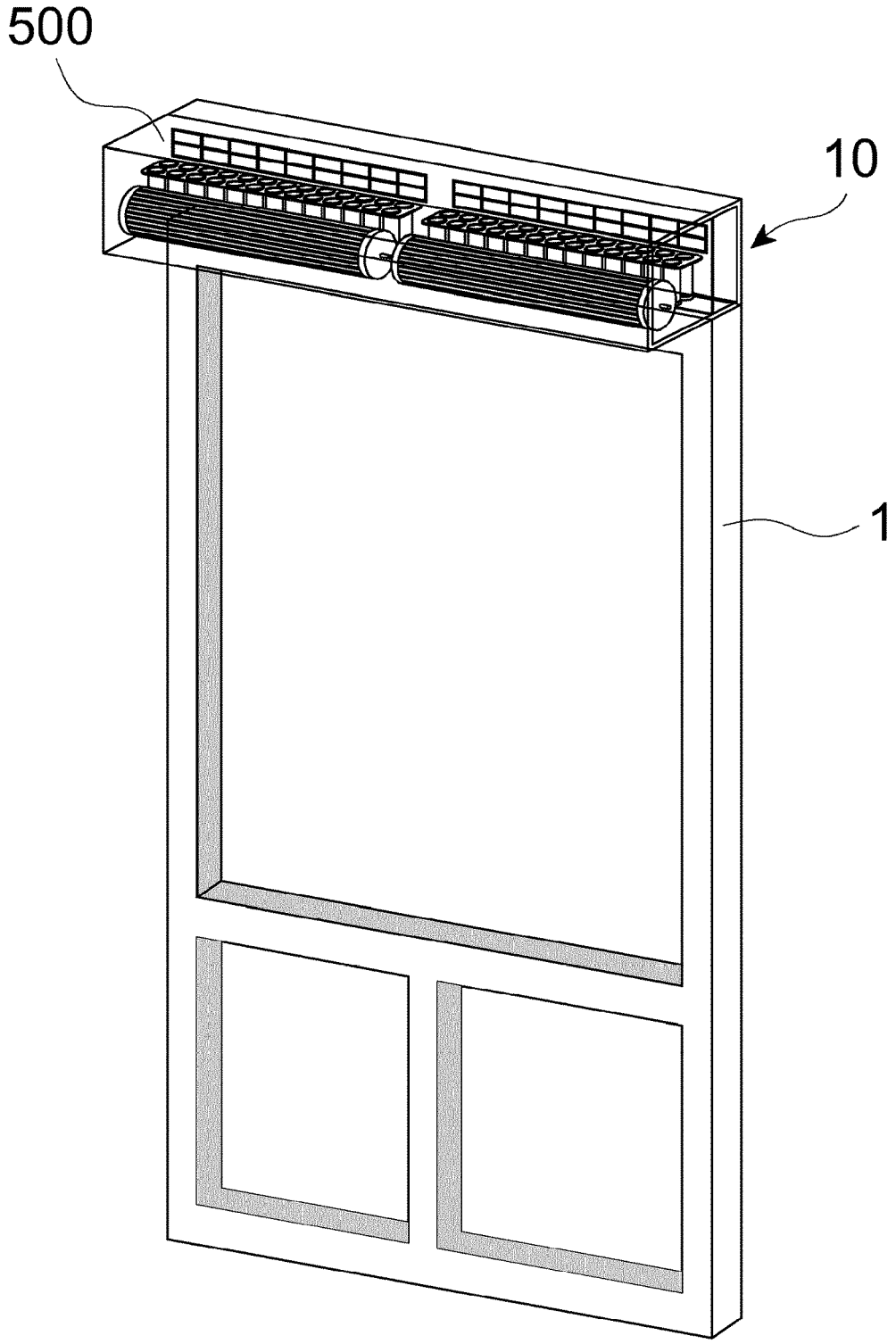

First, in the fine dust removal system 10 of the present disclosure, as shown in FIG. 22, the external housing 500 may be configured such that the clean air outlet 502 is fixed at a lower opening of a window 1 to face the interior, or as shown in FIG. 23, the external housing 500 may be configured such that the clean air outlet 502 is fixed at the upper opening of the window to face the interior.

Here, the external housing 500 may be fixed to the opening of the window 1 through a screw or a dedicated clamp or may be fixed through a separate fixing frame and a gap may be blocked through an air-tight unit (packing or silicon application).

In this case, contaminated air may be introduced into the contaminated air inlet 501 of the fine dust removal system 10 from the outside of the window 1, may undergo the air purification operation as described above, and then may be discharged to the indoor area through the clean air outlet 502, thus performing air cleaning.

Figure 24:
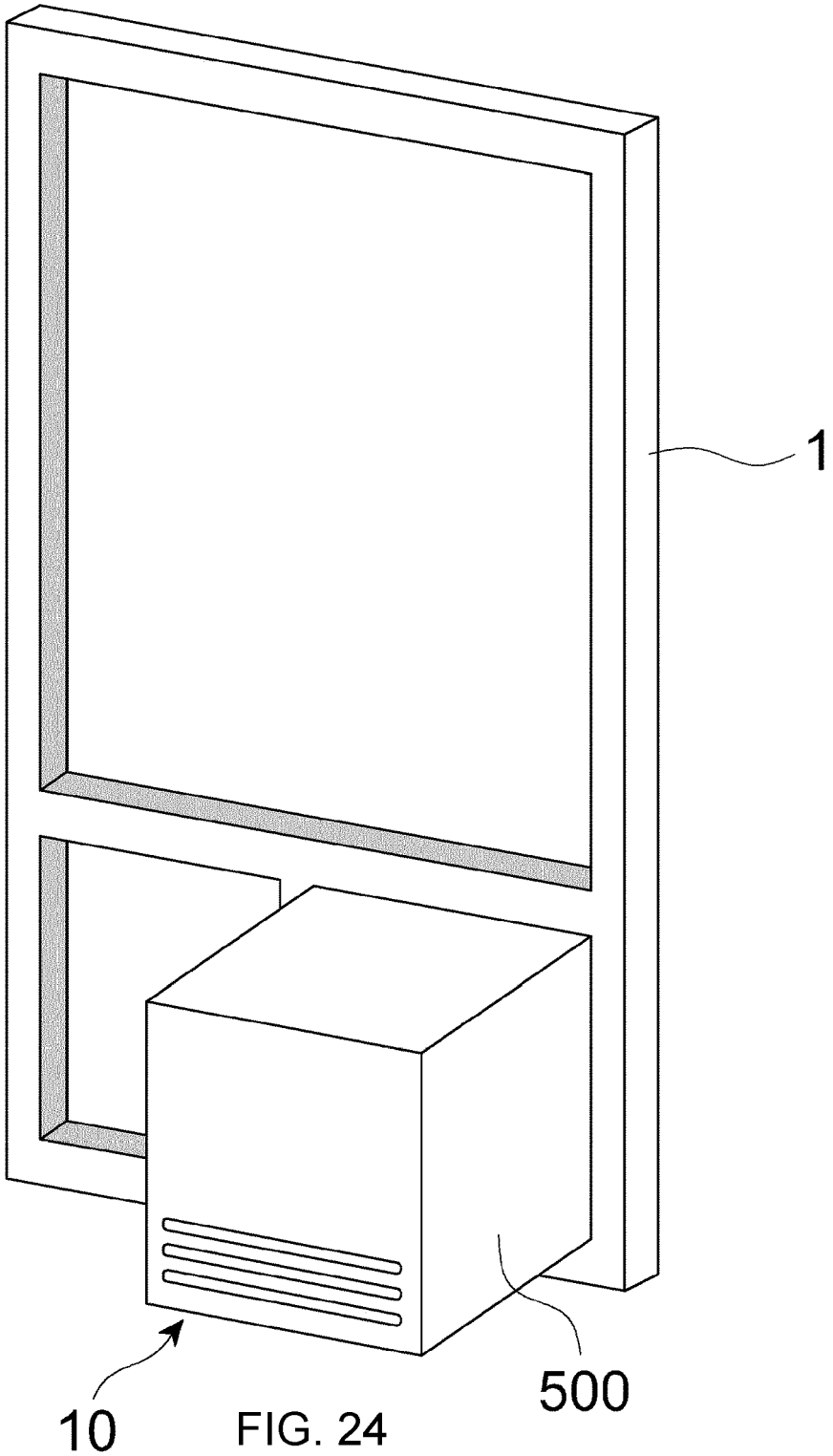

In addition, in the fine dust removal system 10 of the present disclosure, as shown in FIG. 24, the clean air outlet 502 may be fixed to a window frame portion in which the window 1 is installed so as to face the interior.

In this case, the window frame is an open portion in which the window is removed, and if a size of the window frame and a size of the external housing 500 of the fine dust removal system 10 are different (if the external housing 500 has a smaller size), the external housing 500 may be fixed to the window frame through a separate installation frame.

In this case, it may be possible to fix and install the fine dust removal system 10 at the window frame from which the existing window 1 is removed, rather than installing the dedicated window 1, to install the fine dust removal system 10.

Figure 25:
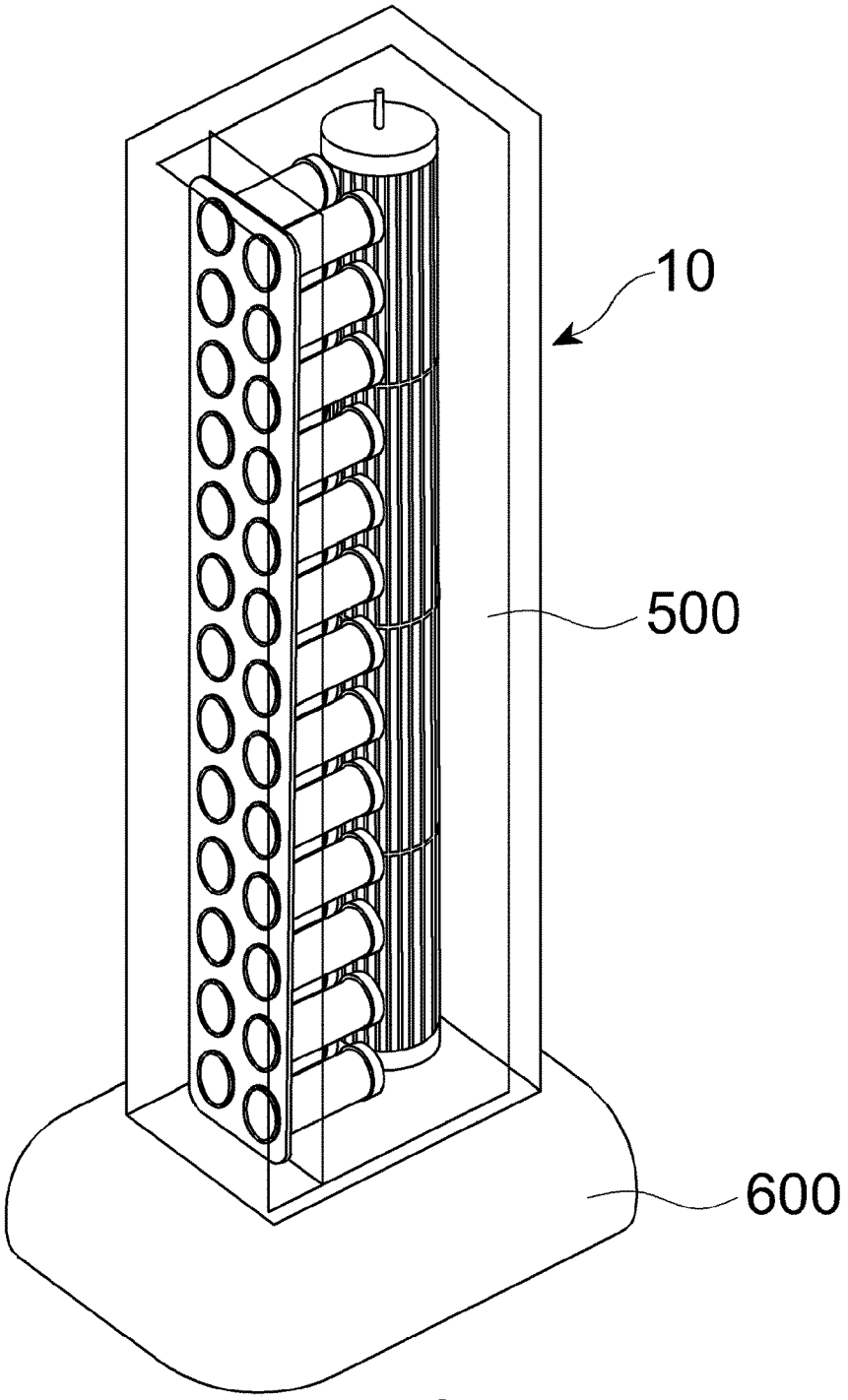
FIGS. 25 and 26 are views illustrating a state in which the present disclosure is vertically applied in the form of a stand.
Figure 26:
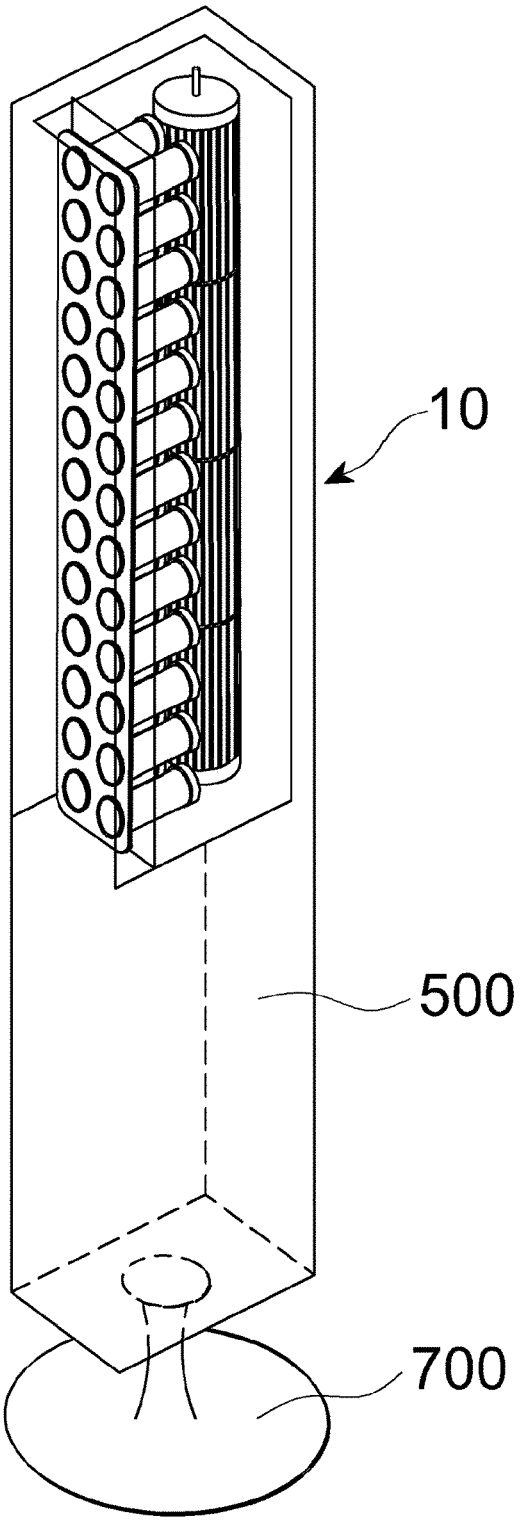
Figure 27:
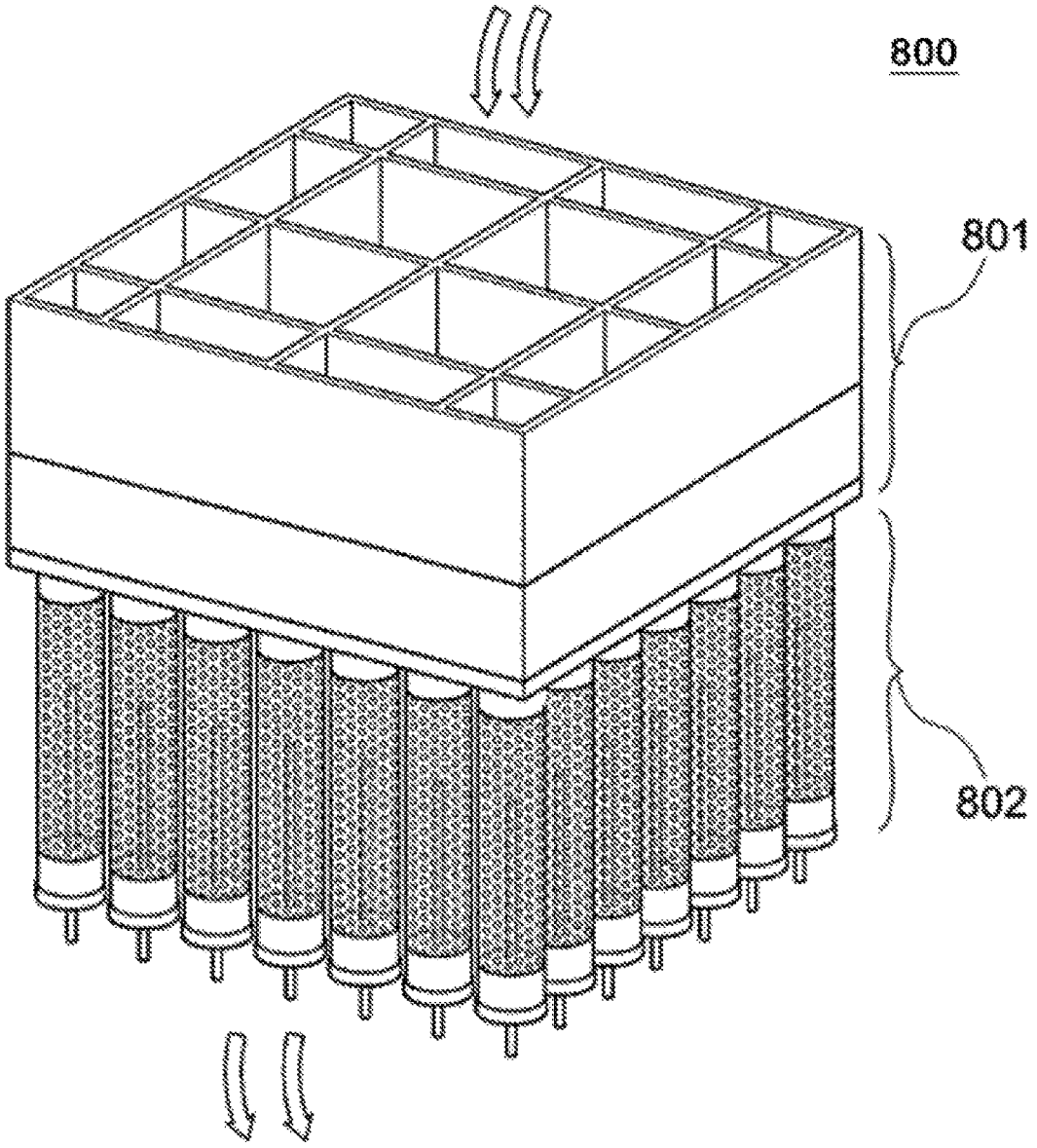
FIG. 27 is a schematic view illustrating a fine dust removal system 800 including an ion generator, an ionizing unit, and a conductive filter module according to an embodiment of the present disclosure.

In addition, in the fine dust removal system 10 of the present disclosure, as shown in FIGS. 25 and 26, the external housing 500 may be provided in a stand form on fixed base 600 or a rotary base 700 which is rotated by a motor (not shown).

Here, in the structure in which the external housing 500 is fixed to the fixed base 600, the external housing 500 is integrally fixed to an upper portion of the fixed base 600 serving as a prop.

In addition, the structure in which the external housing 500 is fixed to the rotary base 700, a lower portion of the external housing 500 is fixed to a rotary shaft of a motor protruding upward from the rotary base 600 serving as a prop.

In this case, as described above, a separate air cleaner may be furnished and used in an indoor area where the fine dust removal system 10 is not applied to the window 1 portion, and as described above, a stand type air cleaner may be used together in an indoor area where the in the window 1 portion is applied to the window 1.

In the case of the stand type fine dust removal system 10, the external housing 500 may be provided at a position 50 to 150 cm above a bottom surface.

In this case, it is possible to increase the efficiency of removing the contaminants including fine dust drift in the indoor air through the air cleaning operation and to discharge clean air as described above.

In the case of the stand type fine dust removal system 10, an air circulation fan for enhancing indoor air circulation may be further installed at a portion 50 cm from the bottom surface of the external housing 500. Here, depending on the situation, the air cleaning structure and the air circulation structure may be interchanged in positions of the upper and lower sides.

In this case, the air circulation fan may further forcibly induce the flow of air to increase the air cleaning efficiency, and the air cleaning structure and the air circulation structure may be changed in position depending on the installation purpose or location or as necessary.

In the fine dust removal system 10 including the conductive filter module 100 of the present disclosure described above, the conductive filter 111 does not necessarily have to maintain a cylindrical shape according to a method of forming a conductive filter and may be modified and formed in any shape that may be able to form an even electric field.

In addition, in the fine dust removal system 10 including the conductive filter module 100 according to an embodiment of the present disclosure, a large number of cylindrical filter modules 100 may be used, the area of the conductive filter 111 may be increased, or both may be increased. In this case, an amount of air that may be purified may be increased and thus, such a fine dust removal system may be used for an industrial purpose, as well as in small-scale air purification systems such as household systems.

Figure 28:
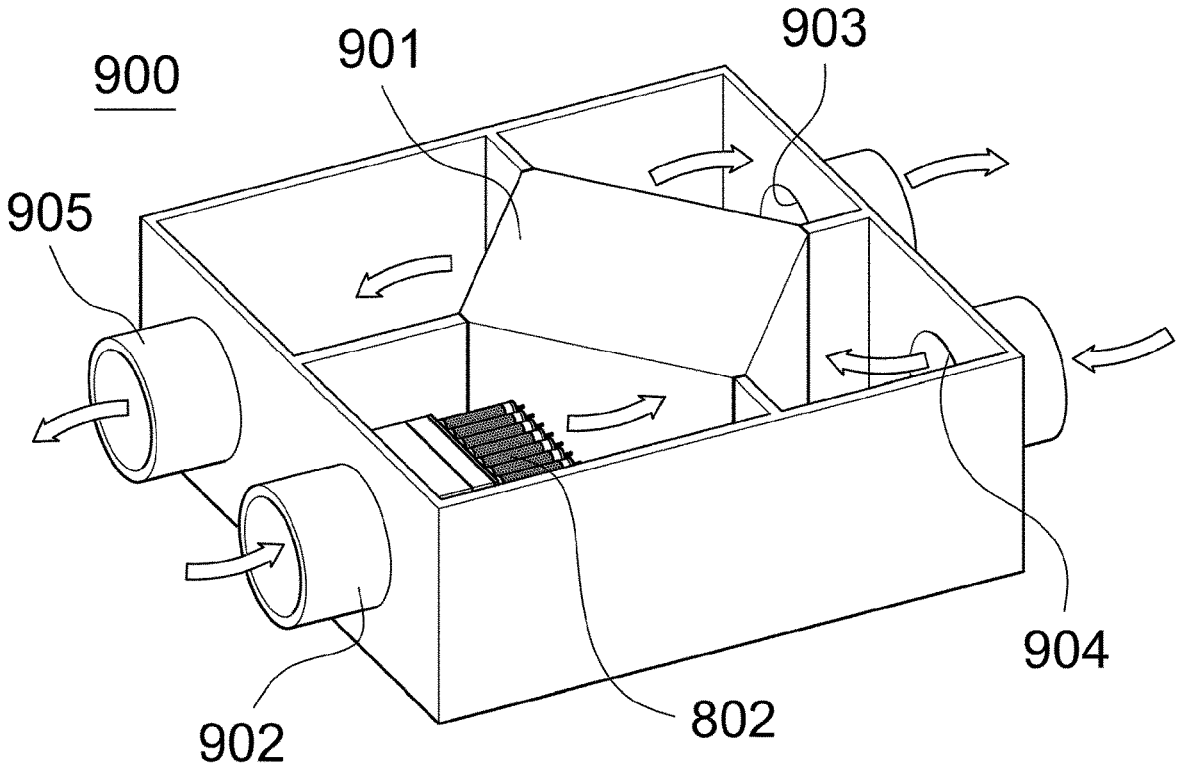
FIGS. 28 and 29 are views illustrating a state 900 in which the present disclosure is applied to a ventilation unit including a heat exchanger.
Figure 29:
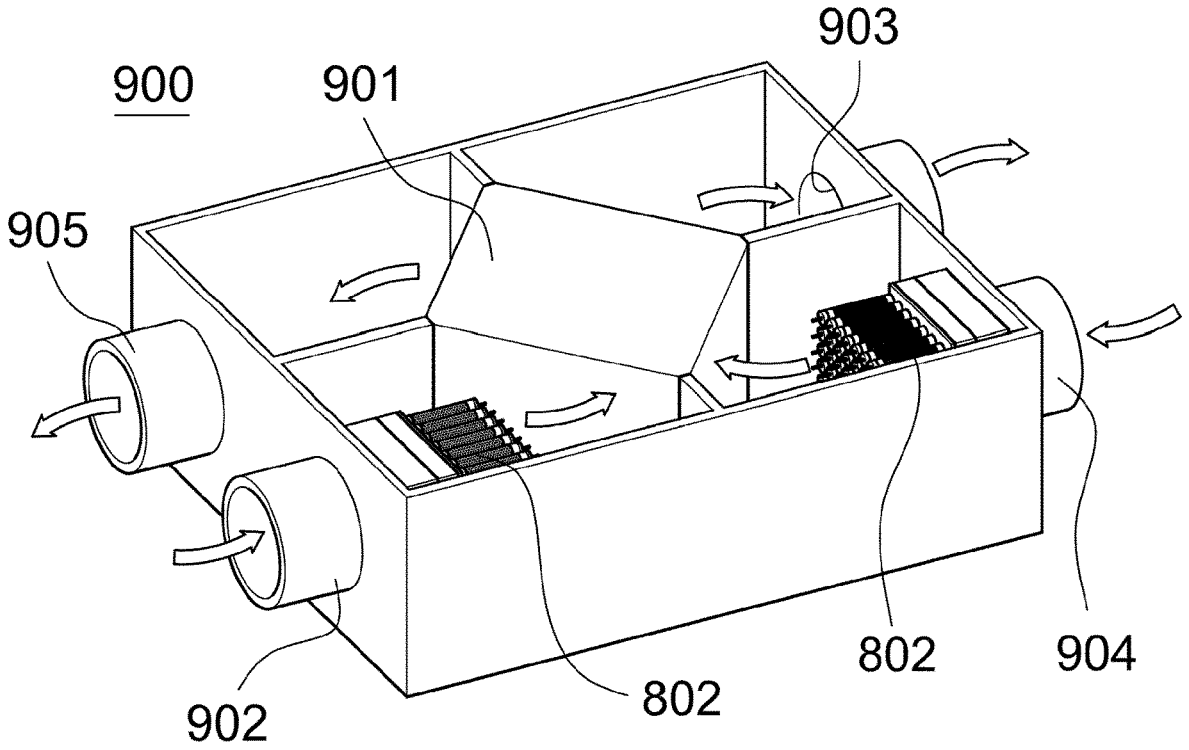

Referring to FIGS. 28 and 29, a fine dust removal system 900 of the present disclosure may include a heat exchange system 901.

Referring to FIG. 28, the fine dust removal system 900 according to an embodiment of the present disclosure includes a housing; an outdoor air inlet 902 providing a passage for introducing outdoor air into the housing; an indoor inlet 903 discharging air introduced through the outdoor air inlet to the outside of the housing; an indoor air inlet 904 providing a passage for introducing indoor air into the housing; an outdoor outlet 905 discharging air introduced through the indoor air inlet to the outside of the housing; a heat exchange system 901 controlling a temperature of air introduced from the outdoor air inlet 902; and a conductive filter module purifying outdoor air introduced into the heat exchange system 901 from the outdoor air inlet 902.

Referring to FIG. 29, the fine dust removal system 900 according to an embodiment of the present disclosure includes a housing; an outdoor air inlet 902 providing a passage for introducing outdoor air into the housing; an indoor inlet 903 discharging air introduced through the outdoor air inlet to the outside of the housing; an indoor air inlet 904 providing a passage for introducing indoor air into the housing; an outdoor outlet 905 discharging air introduced through the indoor air inlet to the outside of the housing; a heat exchange system 901 controlling a temperature of the air introduced from the outdoor air inlet 902 and the indoor air inlet 904; a first conductive filter module purifying air introduced from the outdoor air inlet 902 to the heat exchange system 901; and a second conductive filter module purifying air introduced into the heat exchange system 901 from the indoor air inlet 904.

The second conductive filter module may be mounted at the inlet 904 through which indoor air of the ventilation unit 900 equipped with the heat exchange system 901 is introduced.

As such, in the fine dust removal system 900 according to the embodiment of the present disclosure, the conductive filter module may be mounted only at one of the inlet 902 through which the outdoor air is introduced or the inlet 904 through which the indoor air is introduced, or at both of them.

Through this, contaminants such as fine dust of air introduced into the inlet 904 through which indoor air is introduced are removed by the conductive filter module 802, and the purified indoor air may be discharged to the outdoor area through the outdoor outlet 905, thereby reducing air pollution.

Comparative Example 1

Confirmation of Fine Dust Removal Efficiency of Cylindrical Filter Module Using General Electrode Rod Fine dust removal efficiency was measured by grounding a conductive filter in a state in which a filter flow rate was 20 cm/sec, an ionizer was not actuated, and a DC voltage was not applied to a cylindrical module electrode rod. Here, the removal efficiency was calculated by measuring a concentration of the number of particles of 1 um or less at a front end and rear end of a cylindrical filter module. As a result, the fine dust removal efficiency of the cylindrical filter module using a general electrode rod was measured as 6.7% on average.

Example 1

Confirmation of Fine Dust Removal Efficiency of a Cylindrical Filter Module Using Electrode Rod with Uncut Carbon Member Fine dust removal efficiency of the cylindrical filter module including the electrode rod disposed on the surface of the conductive member was checked in a state where carbon fiber is not cut or ground and has a length of about 1 cm to 5 cm.

Specifically, the fine dust removal efficiency was measured in a state in which a filter flow rate was 20 cm/sec, a DC voltage of −3.0 kV was applied to the cylindrical module electrode, and the conductive filter was grounded. Here, the removal efficiency was calculated by measuring a concentration of the number of particles of 1 um or less at the front end and rear end of the cylindrical filter module. As a result, the removal efficiency of 72.5% on average was obtained under the corresponding conditions.

In addition, efficiency of removing particles of the corresponding size was calculated based on the concentration of the number of particles of 1 um or less at the front end and rear end of a cylindrical filter module when only the DC voltage applied to the cylindrical module electrode was increased to 5.0 kV under the same conditions, and removal efficiency of 90% or greater on average was obtained under the conditions.

In addition, efficiency of removing particle of the corresponding size was calculated based on a concentration of the number of particles of 1 um or less at the front end and rear end of a cylindrical filter module when the filter flow rate was 7 cm/sec or less and −5 kV was applied simultaneously to the ionizer and the cylindrical module electrode rod, and removal efficiency of 99.97 to 100% was obtained under the conditions.

Example 2

Confirmation of Fine Dust Removal Efficiency of Cylindrical Filter Module Using Electrode Rod with Finely Cut Carbon Member Fine dust removal efficiency of the cylindrical filter module including an electrode rod in which a carbon fiber chopped to a length of 7 millimeters is disposed on a surface of a conductive member was checked.

Specifically, the fine dust removal efficiency was measured in a state in which a filter flow rate was 20 cm/sec, a DC voltage of −2.4 kV was applied to the cylindrical module electrode, and the conductive filter was grounded. Here, the removal efficiency was calculated by measuring a concentration of the number of particles of 1 um or less at the front end and rear end of the cylindrical filter module. As a result, the removal efficiency of 77.6% on average was obtained under the corresponding conditions.

In addition, efficiency of removing particles of the corresponding size was calculated based on the concentration of the number of particles of 1 um or less at the front end and rear end of a cylindrical filter module when only the DC voltage applied to the cylindrical module electrode was increased to 5.0 kV under the same conditions, and removal efficiency of 90% or greater on average was obtained under the conditions.

Example 3

Confirmation of Fine Dust Removal Efficiency of Cylindrical Filter Module Using Electrode Rod with Carbon Member in Powder Form The fine dust removal efficiency of the cylindrical filter module including the electrode rod in which carbon fiber in a powder form having a size of 10 um disposed on a surface of a conductive member was checked.

Specifically, the fine dust removal efficiency was measured in a state in which a filter flow rate was 20 cm/sec, a DC voltage of −5.0 kV was applied to the cylindrical module electrode, and the conductive filter was grounded. Here, the removal efficiency was calculated by measuring a concentration of the number of particles of 1 um or less at the front end and rear end of the cylindrical filter module. As a result, the removal efficiency of 95% or more on average was obtained.

As described above, the fine dust removal system equipped with the conductive filter module according to the present disclosure may realize high dust removal efficiency with low pressure loss and may be applied as an air cleaning device for window installation or an independent indoor air cleaning device.

Related Art Document (Related art 1) Korean Patent Laid-Open Publication No. 10-2011-0128465

(Related art 2) Korean Patent Laid-Open Publication No. 10-2016-0044108

(Related art 3) Korean Patent Registration No. 10-0937944

In the conductive filter unit, a conductive filter module including the conductive filter unit, and a fine dust removal system including the conductive filter module according to the present disclosure, an electric field may be evenly applied to the inside of the cylindrical conductive filter to exhibit even an electric precipitation effect as well as a fine dust collecting mechanism of a general filter, further improving the dust collecting effect of the filter.

In the conductive filter unit, a conductive filter module including the conductive filter unit, and a fine dust removal system including the conductive filter module according to the present disclosure, a strong electric field and a large amount of ions are generated between the ionizer and the conductive filter by disposing the carbon member on at least a portion of the surface of the conductive member as an electrode rod, thereby charging even an uncharged fine dust between the ionizer and the conductive filter module, further improving the dust collecting effect of the filter.

In the conductive filter unit, a conductive filter module including the conductive filter unit, and a fine dust removal system including the conductive filter module according to the present disclosure, by disposing the carbon member on at least a portion of the surface of the conductive member as an electrode rod, fine dust particles may be charged through generation of a large amount of ions, and at the same time, a strong electric field may be induced between the electrode rod and the conductive filter, whereby charging and fine dust collecting may be simultaneously performed in the conductive filter unit, even without a separate ionizer, thus realizing the fine dust removal system to be more compact.

In the conductive filter unit, a conductive filter module including the conductive filter unit, and a fine dust removal system including the conductive filter module according to the present disclosure, the electrode rod in which the carbon member is disposed on the surface of the conductive member has a fine dust removal rate of 90% or greater, obtaining an excellent fine dust removal effect, as compared with an electrode rod without a carbon member.

In the conductive filter unit, a conductive filter module including the conductive filter unit, and a fine dust removal system including the conductive filter module according to the present disclosure, as compared with the HEPA filter of the related art, the conductive filter material has a fine dust removal efficiency equal to that of the HEPA filter which is able to remove 99.97% or greater of fine dust having a particle size of 300 nm, has a pressure loss (reduced pressure loss (0.5 Pa to 2 Pa at a filter flow rate of 5 cm/sec)) of 0.1 to 0.2 times and a dust maintaining effect of 3 times or greater, compared with the HEPA filter.

In the conductive filter unit, a conductive filter module including the conductive filter unit, and a fine dust removal system including the conductive filter module according to the present disclosure, due to the reduced pressure loss and enhanced dust maintaining performance as compared with the fine dust removal efficiency, the amount of consuming power of a blower is minimized, thus reducing power consumption, reducing cost, and lengthening a usage term by twice or more.

In addition, in the conductive filter unit, a conductive filter module including the conductive filter unit, and a fine dust removal system including the conductive filter module according to the present disclosure, the conductive filter may be separated, easily cleaned, and re-used.

In addition, in the conductive filter unit, a conductive filter module including the conductive filter unit, and a fine dust removal system including the conductive filter module according to the present disclosure, since the external housing is fixed at the upper or lower opening of the window such that a clean air outlet faces the interior, whereby contaminated air is introduced to the contaminated air inlet of the fine dust removal system, undergoes an air purification operation, and is discharged to the interior through the clean air outlet, thereby cleaning air.

In addition, in the conductive filter unit, a conductive filter module including the conductive filter unit, and a fine dust removal system including the conductive filter module according to the present disclosure, since the clean air outlet is fixed at a window frame portion where the window is installed, to face the interior, a dedicated window is not installed to install the fine dust removal system, and the fine dust removal system may be fixed and installed at a window frame from which the existing window was removed, obtaining generality.

In addition, in the ventilation and indoor air cleaning system which may be installed at a window frame portion where the window is installed, including the conductive filter unit, a conductive filter module including the conductive filter unit, and a fine dust removal system including the conductive filter module according to the present disclosure, since the inlets through which contaminated air is introduced to the ventilation and indoor air cleaning system are disposed at different positions, thereby obtaining an effect of selecting whether to use a filter depending on quality of external air at the time of ventilation. Specifically, one inlet may be disposed at a position where outdoor air may be introduced and another inlet may be disposed at a position where indoor air may be introduced, and thus, when quality of external air is clean, external air introduced to the external air inlet is discharged to the position where the indoor air is introduced without passing through the filter, whereby only ventilation may be performed.

In addition, in the ventilation and indoor air cleaning system which may be installed at a window frame portion where the window is installed, including the conductive filter unit, a conductive filter module including the conductive filter unit, and a fine dust removal system including the conductive filter module according to the present disclosure, one inlet may be disposed at a position where outdoor air may be introduced, the other inlet may be disposed at a position where indoor air may be introduced, and an automatic damper is additionally disposed. Thus, in the case of indoor ventilation through introduction of external air, the indoor air inlet may be blocked by the automatic damper and only the outdoor inlet is left open to allow outdoor air to enter the air cleaning system, be removed in contaminants such as fine dust or the like, and thereafter be introduced to the interior. Also, when sufficient ventilation is performed, the outdoor air inlet may be blocked by the automatic damper and the indoor air inlet is left open for indoor air purification, whereby the indoor air may enter the air cleaning system, removed in contaminants such as fine dust or the like, and may be introduced again to the interior.

In addition, in the conductive filter unit, a conductive filter module including the conductive filter unit, and a fine dust removal system including the conductive filter module according to the present disclosure, since the external housing is provided in a stand form on the fixed base or on the rotary base rotated by a motor (not shown), the fine dust removal system may be furnished as a separate air cleaner and used in the interior in which the fine dust removal system is not applied to the window portion, and when the external housing 500 is provided at a portion 50 to 150 cm above from the bottom surface, contaminants including fine dust drifted in the indoor air may be removed through air purification operation, thereby maximizing efficiency of discharging clean air. In addition, a purification degree of indoor air may be further improved by installing an auxiliary fan helping to circulate indoor air at a lower end of an air purification part.

In addition, the conductive filter unit, a conductive filter module including the conductive filter unit, and a fine dust removal system including the conductive filter module according to the present disclosure may be disposed at an external air inlet of a ventilation unit where a heat exchange system is mounted, thereby removing contaminants such as fine dust or the like of introduced air and improving a purification degree of indoor air by introducing clean air to the interior.

In addition, the conductive filter unit, a conductive filter module including the conductive filter unit, and a fine dust removal system including the conductive filter module according to the present disclosure may be disposed at the external air inlet and the indoor air inlet of the ventilation unit equipped with the heat exchange system, thereby purifying contaminated indoor air and discharging the purified air to the exterior to reduce air pollution.

What is claimed is:

1. A conductive filter unit comprising:

a first electrode cap;

a second electrode cap;

a support connecting the first electrode cap and the second electrode cap;

a conductive filter surrounding a circumferential surface of the support, forming an internal space between the first electrode cap and the second electrode cap, and connected to the first electrode cap; and an electrode rod protruding from a central portion of the second electrode cap to the internal space formed by the conductive filter.

2. The conductive filter unit of claim 1, wherein the electrode rod comprises a conductive member protruding to the internal space formed by the conductive filter from the second electrode cap and a carbon member disposed on at least a portion of a surface of the conductive member.

3. The conductive filter unit of claim 2, wherein the carbon member comprises at least one of carbon fiber and powdery carbon fiber.

4. The conductive filter unit of claim 1, wherein the electrode rod protrudes to extend up to the outside of the second electrode cap.

5. The conductive filter unit of claim 1, wherein the first electrode cap has a ring shape to allow air to be introduced into the internal space of the conductive filter.

6. A fine dust removal system comprising:

a housing;

an ionizer disposed in a contaminated air inlet direction or a clean air outlet direction of the housing;

a conductive filter module, which comprises a filter fixing plate including at least one open air inlet, disposed to face the ionizer with a first space therebetween;

a blower disposed in the contaminated air inlet direction or clean air outlet direction of the housing to induce a flow of air; and the conductive filter unit of claim 1 mounted on the filter fixing plate.

7. The fine dust removal system of claim 6, wherein the housing containing the ionizer, the conductive filter module, and the blower is disposed in an external housing provided with the contaminated air inlet and the clean air outlet correspondingly.

8. The fine dust removal system of claim 7, wherein a first surface of the housing forms a first partition to form a second space with a first inner wall where the contaminated air inlet of the external housing is provided, a second surface of the housing forms a second partition to form a third space with a second inner wall where the clean air outlet of the external housing is provided, a communicating path is formed at a lower portion of the housing between the second and third spaces, the ionizer is provided at an upper portion of the first surface of the housing corresponding to the contaminated air inlet, the conductive filter module is disposed and fixed directly down from an inner middle portion of the housing, and the blower is provided in a fourth space between a portion of the communicating path at a lower side of the second surface of the housing and the clean air outlet.

9. The fine dust removal system of claim 7, wherein, in the external housing, the clean air outlet is fixed at an upper or lower opening of a window to face an interior of the fine dust removal system.

10. The fine dust removal system of claim 7, wherein the external housing is fixed at a window frame of a window such that the clean air outlet faces the interior of the fine dust removal system.

11. The fine dust removal system of claim 9, wherein the external housing comprises a first contaminated air inlet and a second contaminated air inlet disposed at two different positions.

12. The fine dust removal system of claim 11, further comprising:

an automatic damper disposed at each of the first contaminated air inlet and the second contaminated air inlet.

13. The fine dust removal system of claim 7, wherein the external housing is provided in the form of a stand on a fixed base or a rotary base rotated by a motor.

14. The fine dust removal system of claim 13, wherein the external housing is provided 50 cm to 150 cm above a bottom surface.

* * * * *